US010132227B2

(12) United States Patent
Matsumoto et al.

(10) Patent No.: US 10,132,227 B2
(45) Date of Patent: Nov. 20, 2018

(54) COOLING DEVICE FOR INTERNAL COMBUSTION ENGINE

(71) Applicant: DENSO CORPORATION, Kariya, Aichi-pref. (JP)

(72) Inventors: Takeo Matsumoto, Kariya (JP); Daisuke Nakanishi, Kariya (JP)

(73) Assignee: DENSO CORPORATION, Kariya (JP)

( * ) Notice: Subject to any disclaimer, the term of this patent is extended or adjusted under 35 U.S.C. 154(b) by 52 days.

(21) Appl. No.: 15/301,551

(22) PCT Filed: Apr. 2, 2015

(86) PCT No.: PCT/JP2015/001891
§ 371 (c)(1),
(2) Date: Oct. 3, 2016

(87) PCT Pub. No.: WO2015/155964
PCT Pub. Date: Oct. 15, 2015

(65) Prior Publication Data

US 2017/0022881 A1 Jan. 26, 2017

(30) Foreign Application Priority Data

Jul. 4, 2014 (JP) ..... 2014-078312
Mar. 6, 2015 (JP) ..... 2015-045177

(51) Int. Cl.
*F01P 7/16* (2006.01)
*F01P 7/14* (2006.01)

(52) U.S. Cl.
CPC ..... *F01P 7/164* (2013.01); *F01P 7/16* (2013.01); *F01P 7/165* (2013.01);
(Continued)

(58) Field of Classification Search
CPC .... F01P 7/164; F01P 7/165; F01P 7/16; F01P 2025/64; F01P 2025/30; F01P 2025/13;
(Continued)

(56) References Cited

U.S. PATENT DOCUMENTS 6,546,321 B1 * 4/2003 Ohkubo ..... F02D 41/2425 123/486
9,810,136 B2 * 11/2017 Tsuchiya ..... F01P 7/14
(Continued)

FOREIGN PATENT DOCUMENTS

| | | |
|---|---|---|
| JP | 2000-045773 | 2/2000 |
| JP | 2008-196389 | 8/2008 |
| JP | 2009-121543 | 6/2009 |
| JP | 2010-168900 | 8/2010 |
| JP | 2013-124656 | 6/2013 |

*Primary Examiner* — Grant Moubry
(74) *Attorney, Agent, or Firm* — Nixon & Vanderhye PC

(57) ABSTRACT

Upon a valve rotation angle of a flow rate control valve exceeding a radiator-flow-path closed position during changing of the valve rotation angle of the flow rate control valve in an opening direction of a radiator flow path from a closed state of the radiator flow path, a cooling water starts to circulate through the radiator flow path, and an outlet water temperature or an inlet water temperature of an engine starts to drop. The radiator-flow-path closed position is learned as a valve rotation angle of the flow rate control valve immediately before the outlet water temperature or the inlet water temperature starts to drop during changing of the valve rotation angle of the flow rate control valve in the opening direction of the radiator flow path from the closed state of the radiator flow path.

9 Claims, 13 Drawing Sheets

(52) U.S. Cl.
CPC ..... *F01P 2007/146* (2013.01); *F01P 2025/13* (2013.01); *F01P 2025/30* (2013.01); *F01P 2025/32* (2013.01); *F01P 2025/64* (2013.01); *F01P 2031/18* (2013.01); *F01P 2037/00* (2013.01); *F01P 2060/04* (2013.01); *F01P 2060/08* (2013.01)

(58) Field of Classification Search
CPC ..... F01P 2025/32; F01P 2060/04; F01P 2060/08; F01P 2031/18; F01P 2037/00; F01P 2007/146
See application file for complete search history.

(56) References Cited

U.S. PATENT DOCUMENTS

| | | | | |
|---|---|---|---|---|
| 2003/0172882 | A1 | 9/2003 | Nakano | |
| 2004/0267433 | A1 | 12/2004 | Asano et al. | |
| 2007/0272206 | A1 | 11/2007 | Ikeda | |
| 2008/0006244 | A1 | 1/2008 | Asano et al. | |
| 2012/0279462 | A1 | 11/2012 | Warnery et al. | |
| 2013/0255604 | A1 | 10/2013 | Rollinger et al. | |
| 2014/0224361 | A1 | 8/2014 | Warnery et al. | |
| 2015/0013640 | A1* | 1/2015 | Watanuki ..... | F02D 43/00 123/350 |
| 2015/0083057 | A1 | 3/2015 | Tsuchiya et al. | |

* cited by examiner

COOLING DEVICE FOR INTERNAL COMBUSTION ENGINE

CROSS REFERENCE TO RELATED APPLICATION

This application is the U.S. national phase of International Application No. PCT/JP2015/001891 filed Apr. 2, 2015, which designated the U.S. and claims priority to Japanese Patent Applications No. 2014-078312 filed on Apr. 7, 2014 and No. 2015-045177 filed on Mar. 6, 2015 the entire contents of each of which are hereby incorporated by reference.

TECHNICAL FIELD

The present disclosure relates to a cooling device for an internal combustion engine, which is provided with a flow rate control valve regulating a cooling-water flow rate in a cooling-water flow path where cooling water of the internal combustion engine flows.

BACKGROUND ART

A technique of controlling a cooling water temperature of an internal combustion engine is described in, for example, Patent Document 1. The one includes a radiator flow path in which cooling water circulates through a radiator, a bypass flow path in which cooling water circulates to bypass the radiator, and a flow rate control valve regulating cooling-water flow rates in the radiator flow path and the bypass flow path, and controls a cooling water temperature by controlling the flow rate control valve.

PRIOR ART DOCUMENT

Patent Document

Patent Document 1: JP 2003-269171 A

SUMMARY

A radiator-flow-path closed position (operated position of the flow rate control valve when closing the radiator flow path) may vary due to an individual difference (production tolerance) or change with time of the flow rate control valve. A variation (difference) in the radiator-flow-path closed position may possibly cause a phenomenon as follows.

The device includes a type which is further configured to accelerate warm-up of the internal combustion engine by promoting a temperature rise of cooling water by stopping a circulation of cooling water into the radiator flow path while the internal combustion engine is warmed up. However, in a case where the radiator-flow-path closed position of the flow rate control valve has varied, the operated position of the flow rate control valve cannot be controlled to be at a correct radiator-flow-path closed position when a circulation of cooling water into the radiator flow path is stopped by closing the radiator flow path with the flow rate control valve. Accordingly, a cooling water leakage amount into the radiator flow path (an amount of cooling water flowing into the radiator flow path) may possibly increase. When the cooling water leakage amount into the radiator flow path increases, a temperature rise promoting effect on cooling water (warm-up accelerating effect on the internal combustion engine) may be reduced and hence fuel efficiency may possibly be deteriorated.

Cooling water which has passed through the radiator flow path and cooling water which has passed through the bypass flow path have a large water temperature difference and a volume of cooling water is larger in the radiator flow path than in the bypass flow path. Hence, a cooling-water flow rate in the radiator flow path has a significant influence on a cooling water temperature. However, in a case where the radiator-flow-path closed position of the flow rate control valve has varied, the operated position of the flow rate control valve cannot be controlled in reference to the correct radiator-flow-path closed position when a cooling water temperature is controlled by controlling a cooling-water flow rate in the radiator flow path with the flow rate control valve. Hence, control performance on a cooling-water flow rate in the radiator flow path may possibly be degraded. When control performance on a cooling-water flow rate in the radiator flow path is degraded, control performance on a cooling water temperature may be degraded and therefore fuel efficiency and an emission may possibly be deteriorated.

The present disclosure has an object to provide a cooling device for an internal combustion engine capable of enhancing control performance on a cooling water temperature by restricting an inconvenience resulting from a variation (difference) in a flow-path closed position of a flow rate control valve.

According to an aspect of the present disclosure, a cooling device for an internal combustion engine includes a cooling-water flow path through which a cooling water of the internal combustion engine flows, a flow rate control valve regulating a flow rate of the cooling water in the cooling-water flow path, and a closed position learning device learning a flow-path closed position which is an operated position of the flow rate control valve when closing the cooling-water flow path.

Owing to the configuration as above, even when the flow-path closed position of the flow rate control valve has varied due to an individual difference (production tolerance) or deterioration with time of the flow rate control valve, a correct flow-path closed position can be found by learning the varied flow-path closed position. Consequently, control performance on a cooling water temperature can be enhanced by restricting an inconvenience resulting from a variation (difference) in the flow-path closed position of the flow rate control valve.

Herein, the cooling-water flow path includes at least one of a radiator flow path in which cooling water circulates through a radiator, a heater core flow path in which cooling water circulates through a heater core, and an oil cooler flow path in which cooling water circulates through an oil cooler. The closed position learning device may learn at least one of an operated position of the flow rate control valve when closing the radiator flow path, an operated position of the flow rate control valve when closing the heater core flow path, and an operated position of the flow rate control valve when closing the oil cooler flow path, as the flow-path closed position.

When configured as above, a radiator-flow-path closed position (the operated position of the flow rate control valve when closing the radiator flow path), a heater-core-flow-path closed position (the operated position of the flow rate control valve when closing the heater core flow path), and an oil-cooler-flow-path closed position (the operated position of the flow rate control valve when closing the oil cooler flow path) can be learned. For example, by configuring the closed position learning device so as to learn the radiator-flow-path closed position, even when the radiator-flow-path closed position of the flow rate control valve has varied due to an individual difference (production tolerance) or deterioration with time of the flow rate control valve, a correct radiator-flow-path closed position can be found by learning the varied radiator-flow-path closed position. Accordingly, when a circulation of cooling water into the radiator flow path is stopped by closing the radiator flow path with the flow rate control valve while the internal combustion engine is warmed up, the operated position of the flow rate control valve can be controlled to be at the correct radiator-flow-path closed position. Hence, a cooling water leakage amount into the radiator flow path (that is, an amount of cooling water flowing into the radiator flow path) can be reduced. Consequently, deterioration of fuel efficiency can be restricted by restricting a reduction of a temperature rise promoting effect on cooling water (that is, warm-up accelerating effect on the internal combustion engine). Also, the operated position of the flow rate control valve can be controlled in reference to the correct radiator-flow-path closed position when a cooling water temperature is controlled by controlling a cooling-water flow rate in the radiator flow path with the flow rate control valve. Accordingly, control performance on a cooling-water flow rate in the radiator flow path can be enhanced. Consequently, control performance on a cooling water temperature can be enhanced and hence deterioration of fuel efficiency and an emission can be restricted.

DESCRIPTION OF EMBODIMENTS

Figure 1:
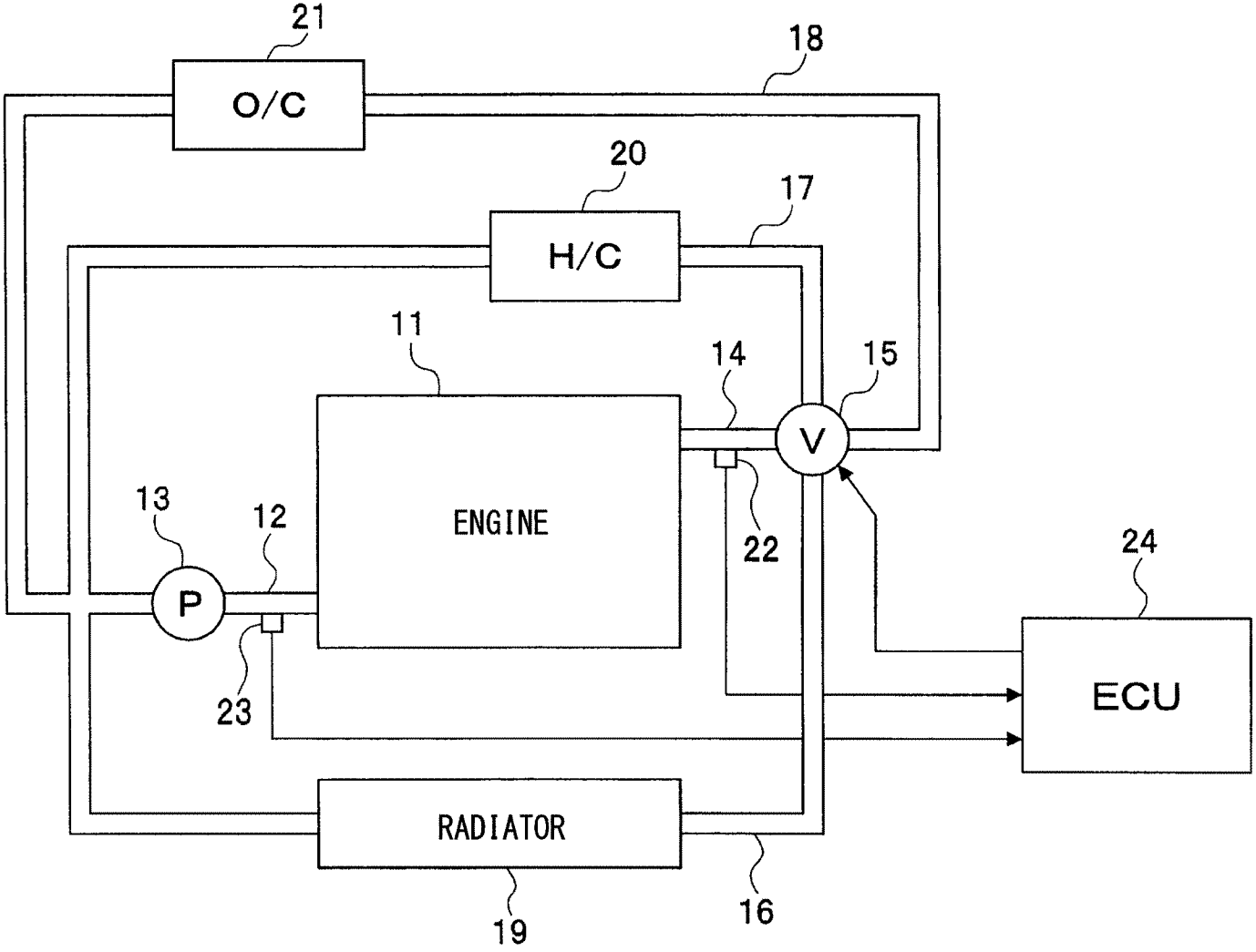
FIG. 1 is a diagram illustrating a schematic configuration of an engine cooling system according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described according to FIG. 1 through FIG. 9.

A schematic configuration of an engine cooling system (a cooling device for an internal combustion engine) will be described first according to FIG. 1.

An inlet flow path 12 is connected to an inlet side of a water jacket (cooling water channel) of an engine 11 as an internal combustion engine and a water pump 13 forcing cooling water of the engine 11 to circulate is provided to the inlet flow path 12. The water pump 13 is a mechanical water pump driven by power of the engine 11. On the other hand, an outlet flow path 14 is connected to an outlet side of the water jacket of the engine 11 and three cooling-water flow paths, namely, a radiator flow path 16, a heater core flow path 17, an oil cooler flow path 18 are connected to the outlet flow path 14 via a flow rate control valve 15.

The radiator flow path 16 is a flow path in which cooling water of the engine 11 circulates through a radiator 19. The heater core flow path 17 is a flow path in which cooling water of the engine 11 circulates through a heater core 20. The oil cooler flow path 18 is a flow path in which cooling water of the engine 11 circulates through an oil cooler 21. Both of the heater core flow path 17 and the oil cooler flow path 18 are bypass flow paths to allow cooling water of the engine 11 to circulate by bypassing the radiator 19. The flow paths 16 through 18 merge in front of the water pump 13 and connect to an inlet port of the water pump 13.

The radiator 19 radiating heat of cooling water is provided at some midpoint in the radiator flow path 16. A heating heater core 20 is provided at some midpoint in the heater core flow path 17. The oil cooler 21 for engine oil cooling engine oil is provided at some midpoint in the oil cooler flow path 18. A thermostat valve opening and closing in response to a cooling water temperature (temperature of cooling water) is not provided herein.

Further, an outlet water temperature sensor 22 detecting a cooling water temperature on a cooling water outlet side of the engine 11 (hereinafter, referred to as the outlet water temperature) is provided to the outlet flow path 14 and an inlet water temperature sensor 23 detecting a cooling water temperature on a cooling water inlet side of the engine 11 (hereinafter, referred to as the inlet water temperature) is provided to the inlet flow path 12.

The flow rate control valve 15 has a valve (not shown) opening and closing a radiator port (an inlet into the radiator flow path 16), a heater core port (an inlet into the heater core flow path 17), and an oil cooler port (an inlet into the oil cooler flow path 18), and regulates cooling-water flow rates in the respective flow paths 16 through 18 according to a rotation angle (operated position) of the valve. The flow rate control valve 15 uses a motor or the like as a drive source. The valve rotates while the flow rate control valve 15 is energized and the valve rotation angle varies. When energization of the flow rate control valve 15 is stopped, a rotation of the valve is stopped and a valve rotation angle is kept at a position where the valve stopped rotating. In short, the flow rate control valve 15 is not furnished with an auto-return function by which a valve rotation angle returns to an initial position when energization is stopped.

Figure 2:
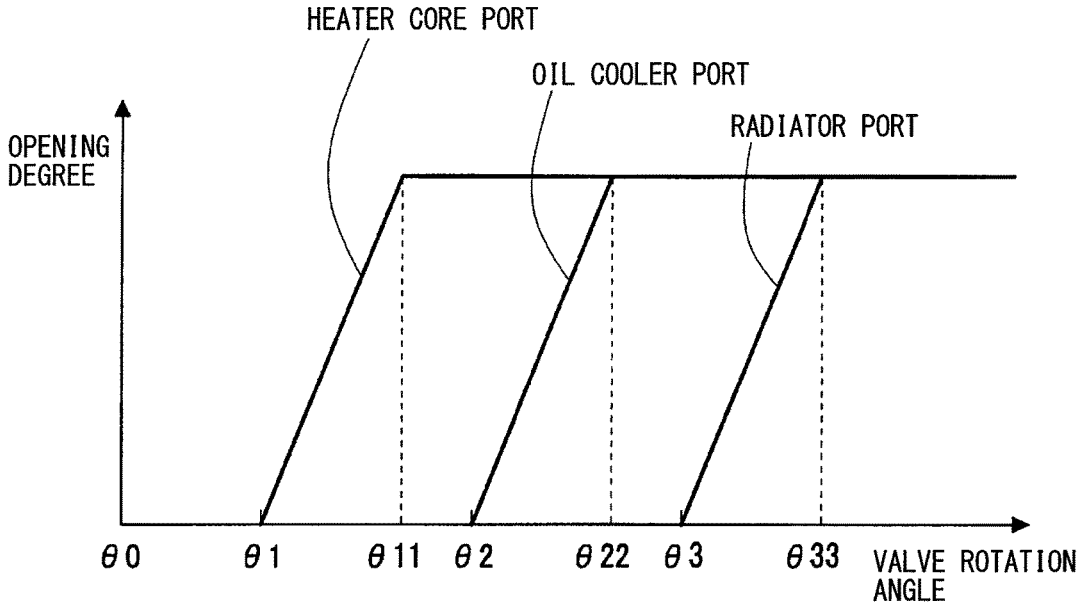
FIG. 2 is a diagram illustrating a relation between a valve rotation angle of a flow rate control valve and opening degrees of respective ports in the first embodiment.

As is shown in FIG. 2, when a valve rotation angle (operated position) of the flow rate control valve 15 is at a fully closed position θ0, all of the radiator port, the heater core port, and the oil cooler port are closed and a circulation of cooling water in the respective flow paths 16 through 18 is stopped.

When the valve rotation angle of the flow rate control valve 15 increases and exceeds a heater-core-flow-path closed position θ1, that is, an operated position of the flow rate control valve 15 when closing the heater core port, the heater core port is opened. Accordingly, cooling water starts to circulate in a route: the water jacket of the engine 11→the outlet flow path 14→the heater core flow path 17 (heater core 20)→the water pump 13→the inlet flow path 12→the water jacket of the engine 11. The heater-core-flow-path closed position θ1 is an operated position of the flow rate control valve 15 immediately before the heater core port is opened, that is, an operated position of the flow rate control valve 15 immediately before cooling water starts to circulate into the heater core flow path 17. While the valve rotation angle of the flow rate control valve 15 is within a predetermined range at or over the heater-core-flow-path closed position θ1 (for example, a range from θ1 to θ11 of FIG. 2), an opening degree (opening area) of the heater core port increases as the valve rotation angle of the flow rate control valve 15 increases, and therefore a cooling-water flow rate in the heater core flow path 17 increases.

When the valve rotation angle of the flow rate control valve 15 increases further and exceeds an oil-cooler-flow-path closed position θ2, that is, an operated position of the flow rate control valve 15 when closing the oil cooler port, the oil cooler port is also opened. Accordingly, cooling water also starts to circulate in a route: the water jacket of the engine 11→the outlet flow path 14→the oil cooler flow path 18 (oil cooler 21)→the water pump 13→the inlet flow path 12→the water jacket of the engine 11. The oil-cooler-flow-path closed position θ2 is an operated position of the flow rate control valve 15 immediately before the oil cooler port is opened, that is, an operated position of the flow rate control valve 15 immediately before cooling water starts to circulate into the oil cooler flow path 18. While the valve rotation angle of the flow rate control valve 15 is within a predetermined range at or over the oil-cooler-flow-path closed position θ2 (for example, a range from θ2 to θ22 of FIG. 2), an opening degree (opening area) of the oil cooler port increases as the valve rotation angle of the flow rate control valve 15 increases and therefore a cooling-water flow rate in the oil cooler flow path 18 increases.

When the valve rotation angle of the flow rate control valve 15 increases still further and exceeds a radiator-flow-path closed position θ3, that is, an operated position of the flow rate control valve 15 when closing the radiator port, the radiator port is also opened. Accordingly, cooling water also starts to circulate in a route: the water jacket of the engine 11→the outlet flow path 14→the radiator flow path 16 (radiator 19)→the water pump 13→the inlet flow path 12→the water jacket of the engine 11. The radiator-flow-path closed position θ3 is an operated position of the flow rate control valve 15 immediately before the radiator port is opened, that is, an operated position of the flow rate control valve 15 immediately before cooling water starts to circulate into the radiator flow path 16. While the valve rotation angle of the flow rate control valve 15 is within a predetermined range at or over the radiator-flow-path closed position θ3 (for example, a range from θ3 to θ33 of FIG. 2), an opening degree (opening area) of the radiator port increases as the valve rotation angle of the flow rate control valve 15 increases and therefore a cooling-water flow rate in the radiator flow path 16 increases.

Outputs of the respective sensors specified above are inputted into an electronic control unit (hereinafter, abbreviated to ECU) 24. The ECU 24 is chiefly formed of a microcomputer and controls an amount of fuel injection, ignition timing, a throttle opening degree (an amount of inlet air), and so on according to an engine operation state by running respective engine control programs pre-stored in an internal ROM (storage medium).

The ECU 24 accelerates warm-up of the engine 11 by promoting a temperature rise of cooling water, which is achieved by stopping a circulation of cooling water into the radiator flow path 16 by closing the radiator port by setting a valve rotation angle of the flow rate control valve 15 at or before the radiator-flow-path closed position θ3 while the engine 11 is warmed up.

The ECU 24 later performs a post-warm-up water temperature control when the outlet water temperature detected by the outlet water temperature sensor 22 or the inlet water temperature detected by the inlet water temperature sensor 23 is higher than or equal to a predetermined value. In the post-warm-up water temperature control, the radiator port is opened by increasing a valve rotation angle of the flow rate control valve 15 to be larger than the radiator-flow-path closed position θ3, and thereby cooling water circulates into the radiator flow path 16. Further, the ECU 24 controls a cooling water temperature by controlling a cooling-water flow rate in the radiator flow path 16 by controlling the rotation angle of the flow rate control valve 15 in response to the outlet water temperature or the inlet water temperature. It should be noted that the valve rotation angle of the flow rate control valve 15 is controlled in reference to the radiator-flow-path closed position θ3.

The radiator-flow-path closed position θ3 of the flow rate control valve 15, that is, an operated position of the flow rate control valve 15 when closing the radiator flow path 16 by closing the radiator port may vary due to an individual difference (for example, production tolerance) or deterioration with time of the flow rate control valve 15.

However, in a case where the radiator-flow-path closed position θ3 of the flow rate control valve 15 has varied, a valve rotation angle of the flow rate control valve 15 cannot be controlled to be at a correct radiator-flow-path closed position θ3 when a circulation of cooling water into the radiator flow path 16 is stopped by closing the radiator port with the flow rate control valve 15. Accordingly, a cooling water leakage amount into the radiator flow path 16, that is, an amount of cooling water flowing into the radiator flow path 16 may possibly increase. When the cooling water leakage amount into the radiator flow path 16 increases, a temperature rise promoting effect on cooling water, that is, a warm-up accelerating effect on the engine 11 may be reduced and hence fuel efficiency may possibly be deteriorated.

Also, in a case where the radiator-flow-path closed position θ3 of the flow rate control valve 15 has varied, a valve rotation angle of the flow rate control valve 15 cannot be controlled in reference to the correct radiator-flow-path closed position θ3 when a cooling water temperature is controlled by controlling a cooling-water flow rate in the radiator flow path 16 with the flow rate control valve 15. Hence, control performance on a cooling-water flow rate in the radiator flow path 16 may possibly be degraded. When the control performance on the cooling-water flow rate in the radiator flow path 16 is degraded, control performance on a cooling water temperature may be degraded and therefore fuel efficiency and an emission may possibly be deteriorated.

Figure 3:
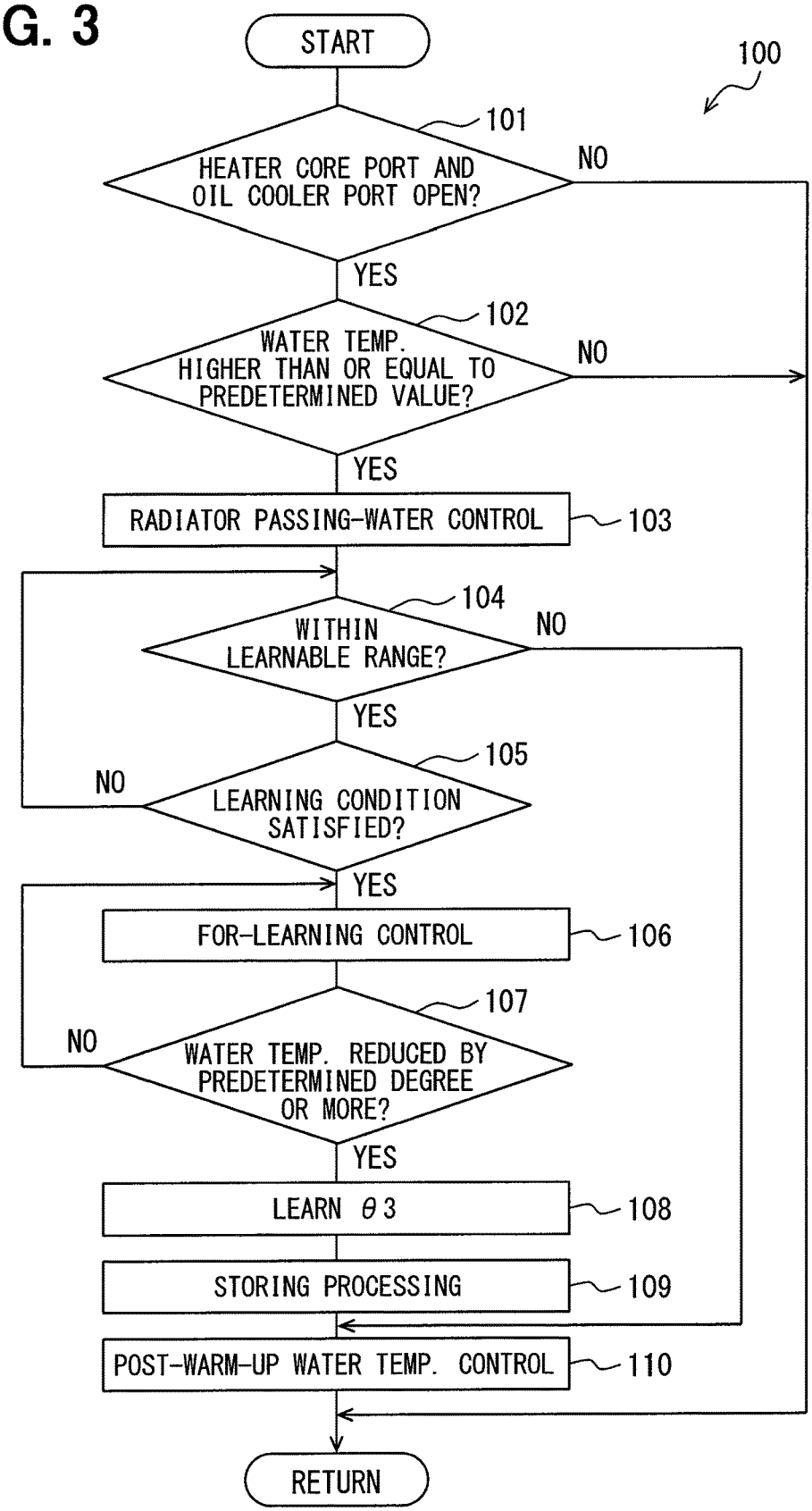
FIG. 3 is a flowchart illustrating a processing flow of a closed position learning routine in the first embodiment.

In order to eliminate such an inconvenience, in the first embodiment, the ECU 24 learns the radiator-flow-path closed position θ3 on the basis of at least one of the outlet water temperature and the inlet water temperature by performing a closed position learning routine 100 of FIG. 3 described below. When a valve rotation angle of the flow rate control valve 15 exceeds the radiator-flow-path closed position θ3, cooling water circulates into the radiator flow path 16 and the outlet water temperature or the inlet water temperature varies. Hence, by monitoring the outlet water temperature or the inlet water temperature, the radiator-flow-path closed position θ3 can be learned.

More specifically, the radiator-flow-path closed position θ3 is learned as a valve rotation angle of the flow rate control valve 15 immediately before at least one of the outlet water temperature and the inlet water temperature starts to drop during changing of the valve rotation angle of the flow rate control valve 15 in an opening direction of the radiator port, that is, an opening direction of the radiator flow path 16 from a state where the radiator port is closed, in other words, a state where the radiator flow path 16 is closed.

That is to say, the outlet water temperature or the inlet water temperature starts to drop as cooling water starts to circulate into the radiator flow path 16 upon the valve rotation angle of the flow rate control valve 15 exceeding the radiator-flow-path closed position θ3 during changing of the valve rotation angle of the flow rate control valve 15 in the opening direction of the radiator port from the state where the radiator port is closed. By paying attention to such characteristics, the radiator-flow-path closed position θ3 is learned as a valve rotation angle of the flow rate control valve 15 immediately before the outlet water temperature or the inlet water temperature starts to drop, that is, a valve rotation angle of the flow rate control valve immediately before cooling water starts to circulate into the radiator flow path 16.

Hereinafter, a processing content of the closed position learning routine 100 of FIG. 3 performed by the ECU 24 in the first embodiment will be described. The closed position learning routine 100 shown in FIG. 3 is performed repetitively in predetermined cycles while a power supply of the ECU 24 is ON. A part of the ECU 24 performing the closed position learning routine 100 may be used as an example of a closed position learning device learning a flow-path closed position. When the routine 100 is started, a determination is made first in Step 101 as to whether both of the heater core port and the oil cooler port are open and the radiator port is closed.

When it is determined in Step 101 that both of the heater core port and the oil cooler port are open and the radiator port is closed, advancement is made to Step 102, in which whether an engine water temperature (cooling water temperature of the engine 11) is higher than or equal to a predetermined value is determined. Herein, whether the engine water temperature is higher than or equal to the predetermined value is determined depending on, for example, whether the outlet water temperature detected by the outlet water temperature sensor 22 or the inlet water temperature detected by the inlet water temperature sensor 23 is higher than or equal to the predetermined value. Alternatively, whether the engine water temperature is higher than or equal to the predetermined value may be determined depending on whether both of the outlet water temperature and the inlet water temperature are higher than or equal to the predetermined value. Further, an engine wall temperature (that is, a wall temperature of the engine 11) may be estimated to determine whether the estimated engine wall temperature is higher than or equal to a predetermined value.

Advancement is made to Step 103 when it is determined in Step 102 that the engine water temperature is higher than or equal to the predetermined value or the engine wall temperature is higher than or equal to the predetermined value. In Step 103, a radiator passing-water control to control cooling water to circulate into the radiator flow path 16 is performed.

Firstly in Step 104, whether an engine operation state (for example, an engine rotation speed and a load) is within a learnable range is determined. Herein, the learnable range is preliminarily set to an engine operation range (for example, a low rotation speed range or a low load range) to prevent an abrupt rise of the engine water temperature or the engine wall temperature.

When it is determined in Step 104 that the engine operation state is not within the learnable range, advancement is made to Step 110, in which the post-warm-up water temperature control is performed in order to avoid the engine water temperature or the engine wall temperature from rising too high. In the post-warm-up water temperature control, the radiator port is opened by increasing a valve rotation angle of the flow rate control valve 15 to be larger than the radiator-flow-path closed position θ3, and thus cooling water circulates into the radiator flow path 16. Further, a cooling water temperature is controlled by controlling a cooling-water flow rate in the radiator flow path 16 via control of the valve rotation angle of the flow rate control valve 15 in response to the outlet water temperature or the inlet water temperature. It should be noted that the valve rotation angle of the flow rate control valve 15 is controlled in reference to a learning value of the radiator-flow-path closed position θ3.

On the other hand, when it is determined in Step 104 that the engine operation state is within the learnable range, advancement is made to Step 105, in which whether a learning condition (for example, a condition for a water temperature to stabilize) is satisfied is determined depending on, for example, whether a vehicle speed is steady within a low vehicle speed range lower than or equal to a predetermined value. Herein, the term, "being steady", means a state in which a vehicle speed is neither increasing nor decreasing. When it is determined in Step 105 that the learning condition is not satisfied, the flow returns to Step 104 described above.

Figure 4:
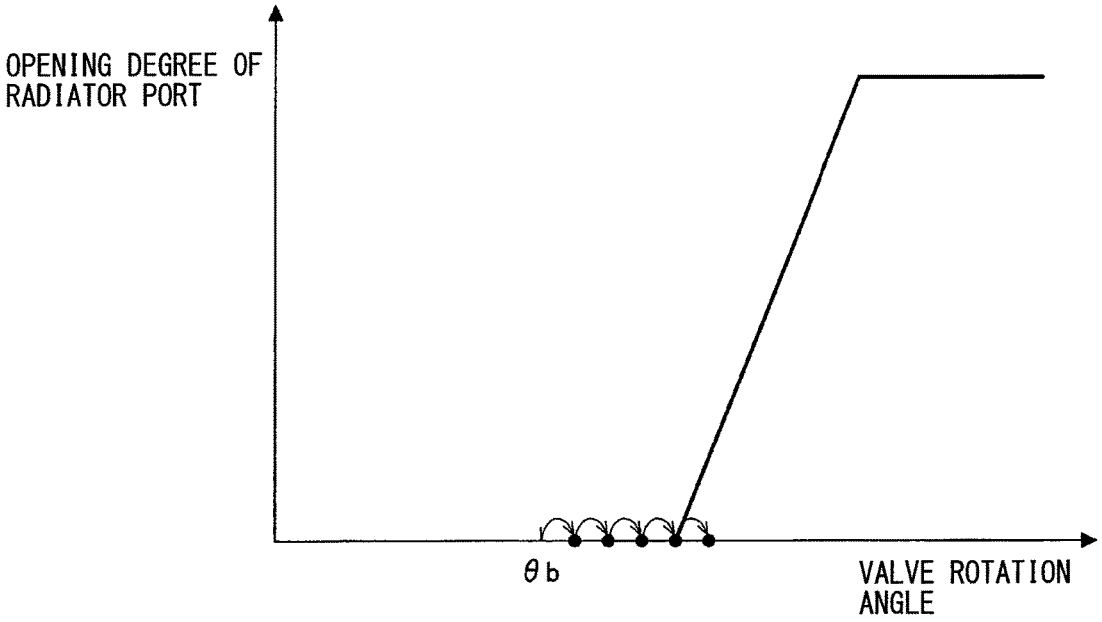
FIG. 4 is a diagram illustrating a first example of a for-learning control in the first embodiment.

On the other hand, when it is determined in Step 105 that the learning condition is satisfied, advancement is made to Step 106, in which a for-learning control is performed. In the for-learning control, for example, as is shown in FIG. 4, the radiator port is closed, that is, the radiator flow path 16 is closed first by controlling a valve rotation angle of the flow rate control valve 15 to be at a reference position θb in the for-learning control.

The reference position θb in the for-learning control is set by, for example, a method (1) or a method (2) as follows.

(1) Regardless of the presence or absence of a last learning value of the radiator-flow-path closed position θ3, the reference position θb is set to a valve rotation angle returned from a temporary learning value (for example, a design center value of the radiator-flow-path closed position θ3) by a predetermined amount in a closing direction of the radiator port.

(2) When the last learning value of the radiator-flow-path closed position θ3 is present, the reference position θb is set to a valve rotation angle returned from the last learning value of the radiator-flow-path closed position θ3 by a predetermined amount in the closing direction of the radiator port. On the other hand, when the last value of the radiator-flow-path closed position θ3 is absent (for example, when the ECU 24 is replaced), the reference position θb is set to a valve rotation angle returned from the temporary learning value by the predetermined amount in the closing direction of the radiator port.

Figure 5:
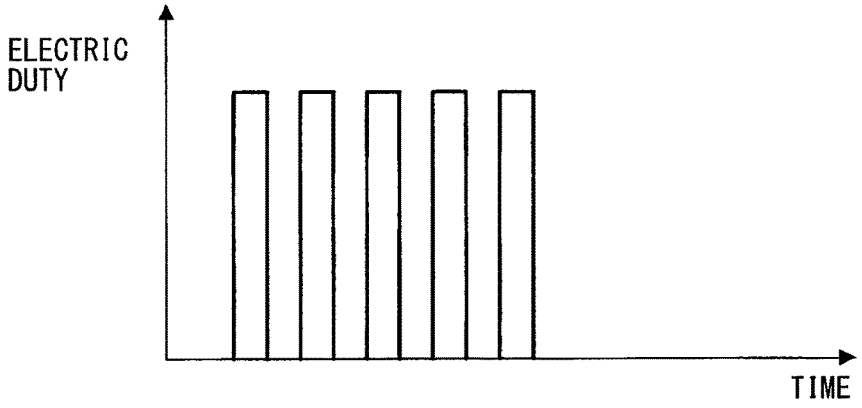
FIG. 5 is a diagram illustrating an energization method of the flow rate control valve in the for-learning control of FIG. 4.

The valve rotation angle of the flow rate control valve 15 is then varied gradually from the reference position θb by a predetermined step amount (constant value) at a time in the opening direction of the radiator port. As to energization of the flow rate control valve 15 in such a case, for example, as is shown in FIG. 5, an electric pulse having a constant electric duty and a constant pulse width is outputted to the flow rate control valve 15 at predetermined time intervals.

During the for-learning control, advancement is made to Step 107 each time the valve rotation angle of the flow rate control valve 15 is varied, and whether the outlet water temperature detected by the outlet water temperature sensor 22 or the inlet water temperature detected by the inlet water temperature sensor 23 has dropped by a predetermined value or more is determined.

When it is determined in Step 107 that the outlet water temperature or the inlet water temperature has not dropped by the predetermined value or more, the flow returns to Step 106 to continue the for-learning control.

Subsequently, advancement is made to Step 108 on the grounds that the outlet water temperature or the inlet water temperature started to drop when it is determined in 107 that the outlet water temperature or the inlet water temperature has dropped by the predetermined value or more. In Step 108, the radiator-flow-path closed position θ3 is learned as a valve rotation angle of the flow rate control valve 15 immediately before the outlet water temperature or the inlet water temperature starts to drop, that is, the last valve rotation angle of the flow rate control valve 15.

Subsequently, advancement is made to Step 109, in which storing processing to update a learning value (stored value) of the radiator-flow-path closed position θ3 is performed by storing a latest learning value of the radiator-flow-path closed position θ3 into a rewritable non-volatile memory, such as a backup RAM (not shown) of the ECU 24. The non-volatile memory means a rewritable memory capable of holding stored data even when the power supply of the ECU 24 is OFF.

Subsequently, advancement is made to Step 110, in which the post-warm-up water temperature control is performed. In the post-warm-up water temperature control, the radiator port is opened by increasing a valve rotation angle of the flow rate control valve 15 to be larger than the radiator-flow-path closed position θ3, and thus cooling water circulates into the radiator flow path 16. Further, a cooling water temperature is controlled by controlling a cooling-water flow rate in the radiator flow path 16 via a control of the rotation angle of the flow rate control valve 15 in response to the outlet water temperature or the inlet water temperature. It should be noted that the valve rotation angle of the flow rate control valve 15 is controlled in reference to the learning value of the radiator-flow-path closed position θ3.

In the first embodiment described above, by paying attention to the characteristics that when a valve rotation angle of the flow rate control valve 15 exceeds the radiator-flow-path closed position θ3, the outlet water temperature or the inlet water temperature varies because cooling water starts to circulate into the radiator flow path 16, the radiator-flow-path closed position θ3 is learned on the basis of the outlet water temperature or the inlet water temperature. Owing to the configuration as above, even when the radiator-flow-path closed position θ3 of the flow rate control valve 15 has varied due to an individual difference (production tolerance) or deterioration with time of the flow rate control valve 15, a correct radiator-flow-path closed position θ3 can be found by learning the varied radiator-flow-path closed position θ3.

Accordingly, when a circulation of cooling water into the radiator flow path 16 is stopped by closing the radiator port with the flow rate control valve 15 while the engine 11 is warmed up, a valve rotation angle of the flow rate control valve 15 can be controlled to be at the correct radiator-flow-path closed position θ3. Hence, a cooling water leakage amount into the radiator flow path 16 can be reduced. Consequently, deterioration of fuel efficiency can be restricted by restricting a reduction of the temperature rise promoting effect on cooling water, that is, the warm-up accelerating effect on the engine 11. In addition, a valve rotation angle of the flow rate control valve 15 can be controlled in reference to the correct radiator-flow-path closed position θ3 when a cooling water temperature is controlled by controlling a cooling-water flow rate in the radiator flow path 16 with the flow rate control valve 15. Hence, control performance on a cooling-water flow rate in the radiator flow path 16 can be enhanced. Consequently, control performance on a cooling water temperature can be enhanced and therefore deterioration of fuel efficiency and an emission can be restricted.

In the first embodiment, the radiator-flow-path closed position θ3 is learned on the basis of the outlet water temperature detected by the outlet water temperature sensor 22 or the inlet water temperature detected by the inlet water temperature sensor 23. When configured as above, the radiator-flow-path closed position θ3 can be learned using the outlet water temperature sensor 22 or the inlet water temperature sensor 23 originally provided to control a cooling water temperature of the engine 11. Hence, a new sensor (for example, a sensor detecting a flow rate or a pressure of cooling water) used to learn the radiator-flow-path closed position θ3 is not necessary and a demand for a cost reduction can be satisfied.

The outlet water temperature or the inlet water temperature starts to drop as cooling water starts to circulate into the radiator flow path 16 upon a valve rotation angle of the flow rate control valve 15 exceeding the radiator-flow-path closed position θ3 during changing of the valve rotation angle of the flow rate control valve 15 in the opening direction of the radiator port from the state where the radiator port is closed.

In the first embodiment, by paying attention to such characteristics, the radiator-flow-path closed position θ3 is learned as a valve rotation angle of the flow rate control valve 15 immediately before the outlet water temperature or the inlet water temperature starts to drop during changing of the valve rotation angle of the flow rate control valve 15 in the opening direction of the radiator port from the state where the radiator port is closed. Consequently, the radiator-flow-path closed position θ3 can be learned at high accuracy.

In the first embodiment, when the outlet water temperature or the inlet water temperature drops by a predetermined value or more, the radiator-flow-path closed position is learned as a valve rotation angle of the flow rate control valve 15 immediately before such temperature drop. The present disclosure, however, is not limited to the configuration as above. For example, when both the outlet water temperature and the inlet water temperature drops by a predetermined value or more, the radiator-flow-path closed position may be learned as a valve rotation angle of the flow rate control valve 15 immediately before such temperature drop.

Alternatively, an expected engine wall temperature may be calculated using a map or the like on the basis of an engine operation state (for example, an engine rotation speed and a load) and also an engine wall temperature estimation value may be calculated on the basis of at least one of the outlet water temperature, the inlet water temperature, and an oil temperature. When a difference (a deviation amount) between the expected engine wall temperature and the engine wall temperature estimation value becomes larger than or equal to a predetermined value, a valve rotation angle of the flow rate control valve 15 immediately before the difference becomes larger than or equal to the predetermined value may be learned as the radiator-flow-path closed position.

Further, an actual engine wall temperature may be detected by a sensor and also an engine wall temperature estimation value may be calculated on the basis of at least one of the outlet water temperature, the inlet water temperature, and the oil temperature. When a difference (a deviation amount) between the actual engine wall temperature and the engine wall temperature estimation value becomes larger than or equal to a predetermined value, a valve rotation angle of the flow rate control valve 15 immediately before the difference becomes larger than or equal to the predetermined value may be learned as the radiator-flow-path closed position.

The for-learning control is not limited to the for-learning control described in the first embodiment and can be changed as needed.

Figure 6:
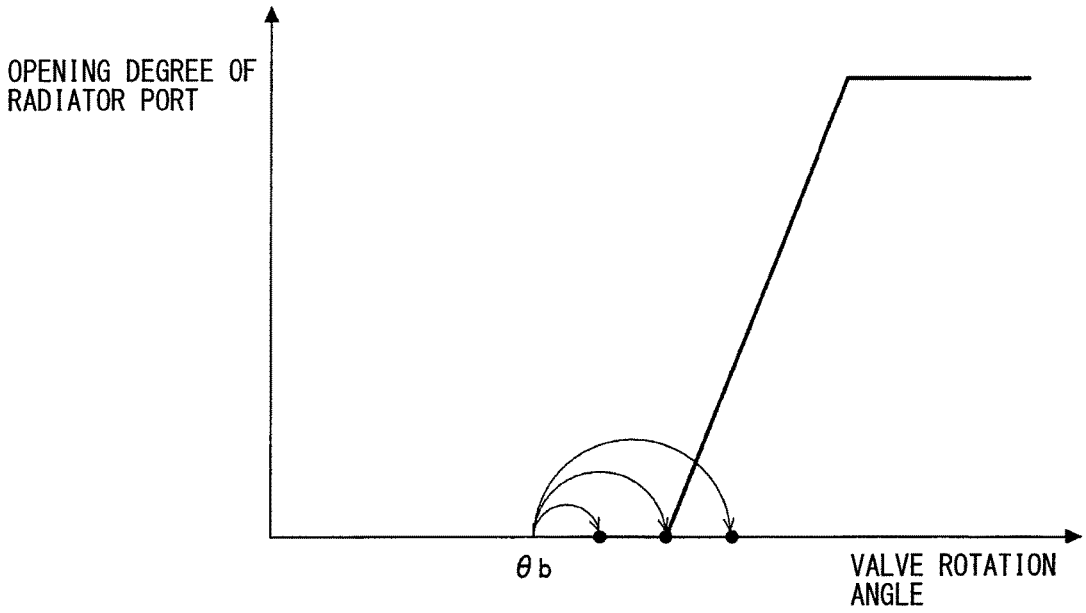
FIG. 6 is a diagram illustrating a second example of the for-learning control in the first embodiment.
Figure 7:
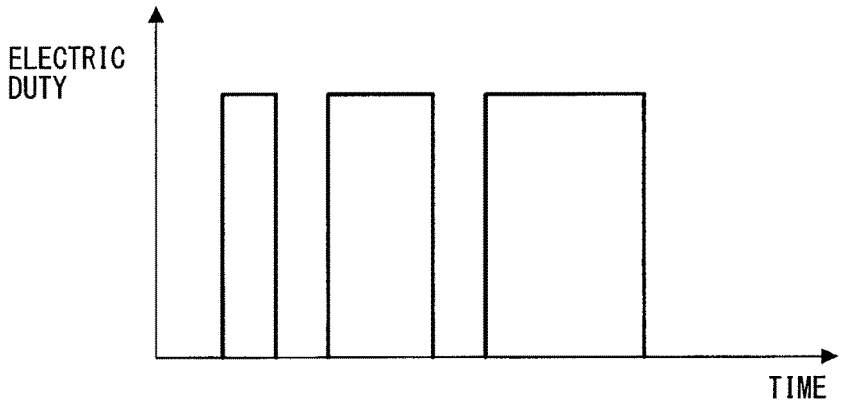
FIG. 7 is a diagram illustrating an energization method of the flow rate control valve in the for-learning control of FIG. 6.

An example of the for-learning control is shown in FIG. 6. Herein, a predetermined step amount is increased from a last step amount by repeating processing, in which after a valve rotation angle of the flow rate control valve 15 is controlled to be at the reference position θb in the for-learning control, the valve rotation angle of the flow rate control valve 15 is varied from the reference position θb by the predetermined step amount in the opening direction of the radiator port first and then the valve rotation angle of the flow rate control valve 15 is returned to the reference position θb. As to energization of the flow rate control valve 15 in such a case, for example, as is shown in FIG. 7, a pulse width is widened from a last pulse width each time an electric pulse having a constant electric duty is outputted while the electric pulse is outputted to the flow rate control valve 15 at predetermined time intervals.

Figure 8:
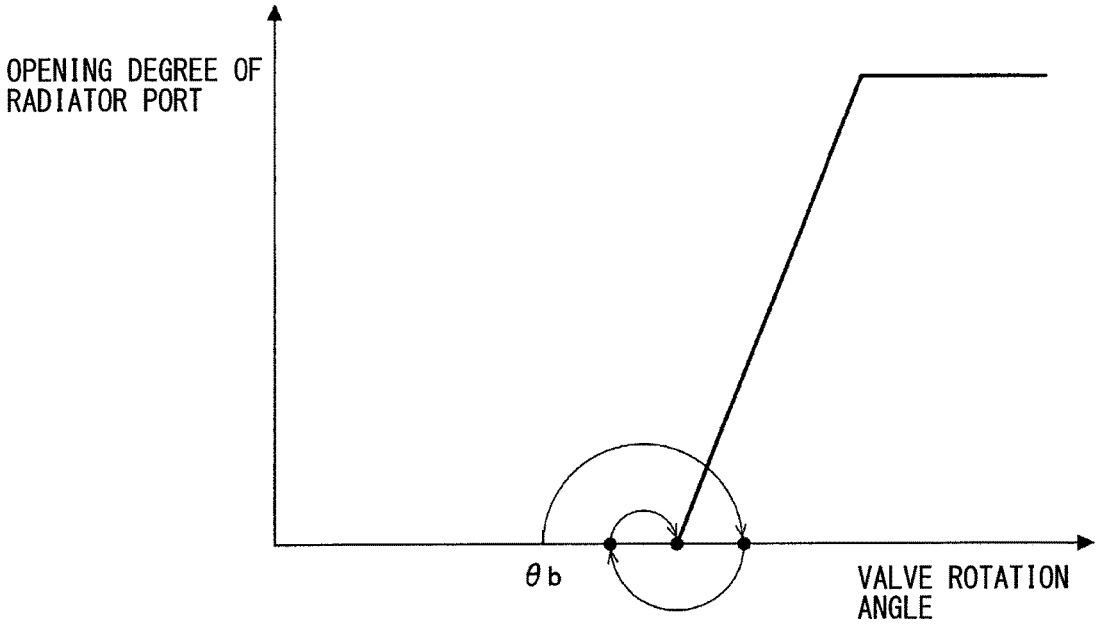
FIG. 8 is a diagram illustrating a third example of the for-learning control in the first embodiment.
Figure 9:
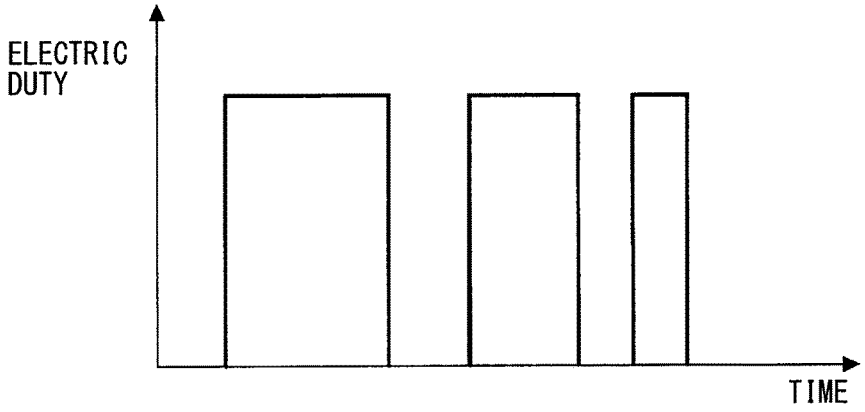
FIG. 9 is a diagram illustrating an energization method of the flow rate control valve in the for-learning control of FIG. 8.

Another example of the for-learning control is shown in FIG. 8. Herein, a predetermined step amount is decreased from a last step amount by repeating processing, in which after a valve rotation angle of the flow rate control valve 15 is controlled to be at the reference position θb in the for-learning control, the valve rotation angle of the flow rate control valve 15 is varied from the reference position θb by the predetermined step amount in the opening direction of the radiator port, and after a predetermined time has elapsed, the valve rotation angle of the flow rate control valve 15 is varied by the predetermined step amount in the closing direction of the radiator port. As to energization of the flow rate control valve 15 in such a case, for example, as is shown in FIG. 9, a pulse width is narrowed from a last pulse width and also predetermined time intervals are made shorter each time an electric pulse having a constant electric duty is outputted while the electric pulse is outputted to the flow rate control valve 15 at the predetermined time intervals.

Second Embodiment

A second embodiment of the present disclosure will now be described using FIG. 10 through FIG. 18. For a portion substantially same as a counterpart in the first embodiment above, a description is omitted or only a brief description is given and a description is chiefly given to a portion different from the first embodiment above.

In the second embodiment, a heater-core-flow-path closed position θ1, an oil-cooler-flow-path closed position θ2, and a radiator-flow-path closed position θ3 are learned while an engine 11 is warmed up as an ECU 24 performs routines 200, 300, 400, and 500 of FIGS. 11, 12, 13, and 14, respectively, described below.

Figure 10:
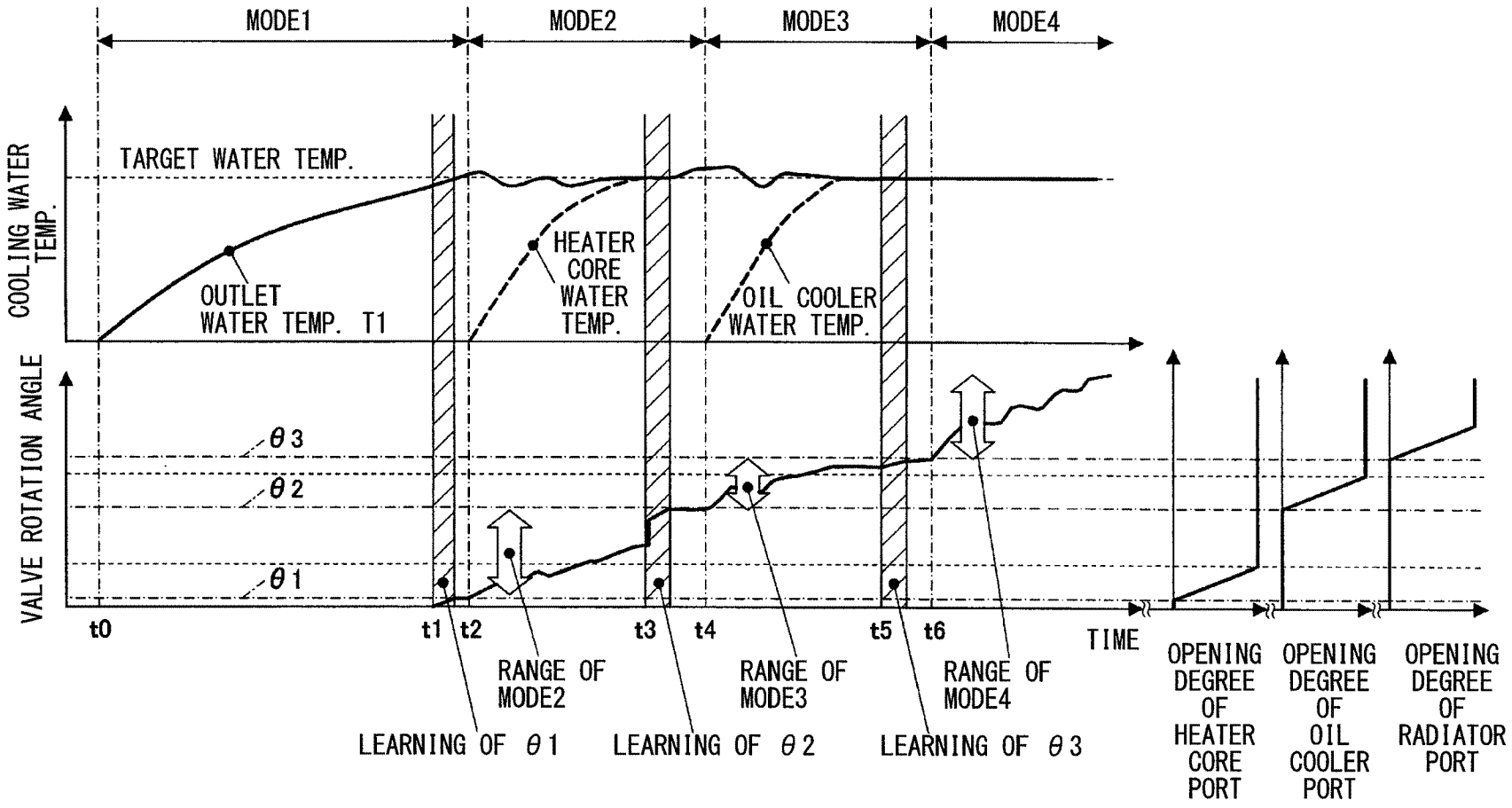
FIG. 10 is a time chart illustrating learning of a flow-path closed position in a second embodiment of the present disclosure.

More specifically, as is shown in FIG. 10, a control mode when the engine 11 is started at a time t0 (or when a power supply of the ECU 24 is switched ON) is set to MODE 1. In MODE 1, a valve rotation angle of a flow rate control valve 15 is controlled to be at a fully closed position θ0 to close all of a radiator port, a heater core port, and an oil cooler port, that is, to close all of a radiator flow path 16, a heater core flow path 17, and an oil cooler flow path 18.

While the control mode is set in MODE 1, the heater-core-flow-path closed position θ1 is learned as follows at a time t1 when a learning execution condition of the heater-core-flow-path closed position θ1 is satisfied (for example, when an outlet water temperature T1 rises to or above a predetermined value).

The heater-core-flow-path closed position θ1 is learned as a valve rotation angle of the flow rate control valve 15 immediately before an inlet water temperature T2 starts to drop during changing of the valve rotation angle of the flow rate control valve 15 in an opening direction of the heater core port, that is, an opening direction of the heater core flow path 17 from a state where the heater core port is closed, that is, a state where the heater core flow path 17 is closed.

That is to say, the inlet water temperature T2 starts to drop as cooling water starts to circulate into the heater core flow path 17 upon a valve rotation angle of the flow rate control valve 15 exceeding the heater-core-flow-path closed position θ1 during changing of the valve rotation angle of the flow rate control valve 15 in the opening direction of the heater core port from the state where the heater core port is closed. By paying attention to such characteristics, the heater-core-flow-path closed position θ1 is learned as a valve rotation angle of the flow rate control valve 15 immediately before the inlet water temperature T2 starts to drop, that is, a valve rotation angle of the flow rate control valve immediately before cooling water starts to circulate into the heater core flow path 17.

The control mode is switched to MODE 2 later at a time t2 when the outlet water temperature T1 rises to or above a target water temperature. In MODE 2, a valve rotation angle of the flow rate control valve 15 is F/B (Feed-Back) controlled within an available range of MODE 2 on the basis of a deviation between the outlet water temperature T1 and the target water temperature. The available range of MODE 2 is preliminarily set to a range from the heater-core-flow-path closed position θ1 to the oil-cooler-flow-path closed position θ2. Accordingly, a cooling-water flow rate in the heater core flow path 17 is controlled by controlling an opening degree of the heater core port so as to reduce a deviation between the outlet water temperature T1 and the target water temperature.

While the control mode is set in MODE 2, the oil-cooler-flow-path closed position θ2 is learned as follows at a time t3 when a learning execution condition of the oil-cooler-flow-path closed position θ2 is satisfied (for example, when a variation in the outlet water temperature T1 per predetermined time, ΔT1, becomes smaller or equal to a predetermined value).

The oil-cooler-flow-path closed position θ2 is learned as a valve rotation angle of the flow rate control valve 15 immediately before the inlet water temperature T2 starts to drop during changing of the valve rotation angle of the flow rate control valve 15 in an opening direction of the oil cooler port, that is, an opening direction of the oil cooler flow path 18 from a state where the oil cooler port is closed, that is, a state where the oil cooler flow path 18 is closed.

That is to say, the inlet water temperature T2 starts to drop as cooling water starts to circulate into the oil cooler flow path 18 upon a valve rotation angle of the flow rate control valve 15 exceeding the oil-cooler-flow-path closed position θ2 during changing of the valve rotation angle of the flow rate control valve 15 in the opening direction of the oil cooler port from the state where the oil cooler port is closed. By paying attention to such characteristics, the oil-cooler-flow-path closed position θ2 is learned as a valve rotation angle of the flow rate control valve 15 immediately before the inlet water temperature T2 starts to drop, that is, a valve rotation angle of the flow rate control valve immediately before cooling water starts to circulate into the oil cooler flow path 18.

The control mode is switched to MODE 3 later at a time t4 when the outlet water temperature T1 is kept higher than or equal to the target water temperature for a predetermined time or longer. In MODE 3, a valve rotation angle of the flow rate control valve 15 is F/B controlled within an available range of MODE3 on the basis of a deviation between the outlet water temperature T1 and the target water temperature. The available range of MODE 3 is preliminarily set to a range from the oil-cooler-flow-path closed position θ2 to the radiator-flow-path closed position θ3. Accordingly, a cooling-water flow rate in the oil cooler flow path 18 is controlled by controlling an opening degree of the oil cooler port so as to reduce a deviation between the outlet water temperature T1 and the target water temperature.

While the control mode is set in MODE 3, the radiator-flow-path closed position θ3 is learned as follows at a time t5 when a learning execution condition of the radiator-flow-path closed position θ3 is satisfied (for example, when the variation in the outlet water temperature T1 per predetermined time, ΔT1, becomes smaller or equal to a predetermined value).

The radiator-flow-path closed position θ3 is learned as a valve rotation angle of the flow rate control valve 15 immediately before the inlet water temperature T2 starts to drop upon the valve rotation angle of the flow rate control valve 15 being varied in an opening direction of the radiator port, that is, an opening direction of the radiator flow path 16 from a state where the radiator port is closed, that is, a state where the radiator flow path 16 is closed.

That is to say, the inlet water temperature T2 starts to drop as cooling water starts to circulate into the radiator flow path 16 upon a valve rotation angle of the flow rate control valve 15 exceeding the radiator-flow-path closed position θ3 during changing of the valve rotation angle of the flow rate control valve 15 in the opening direction of radiator port from the state where the radiator port is closed. By paying attention to such characteristics, the radiator-flow-path closed position θ3 is learned as a valve rotation angle of the flow rate control valve 15 immediately before the inlet water temperature T2 starts to drop, that is, a valve rotation angle of the flow rate control valve immediately before cooling water starts to circulate into the radiator flow path 16.

The control mode is switched to MODE 4 later at a time t6 when the outlet water temperature T1 is kept higher than or equal to the target water temperature for a predetermined time or longer. In MODE 4, a valve rotation angle of the flow rate control valve 15 is F/B controlled within an available range of MODE4 on the basis of a deviation between the outlet water temperature T1 and the target water temperature. The available range of MODE 4 is preliminarily set to a range at or over the radiator-flow-path closed position θ3. Accordingly, a cooling-water flow rate in the radiator flow path 16 is controlled by controlling an opening degree of the radiator port so as to reduce a deviation between the outlet water temperature T1 and the target water temperature. Hereinafter, processing contents of the routines 200, 300, 400, and 500 of FIG. 11, FIG. 12, FIG. 13, and FIG. 14, respectively, performed by the ECU 24 in the second embodiment will be described.

Figure 11:
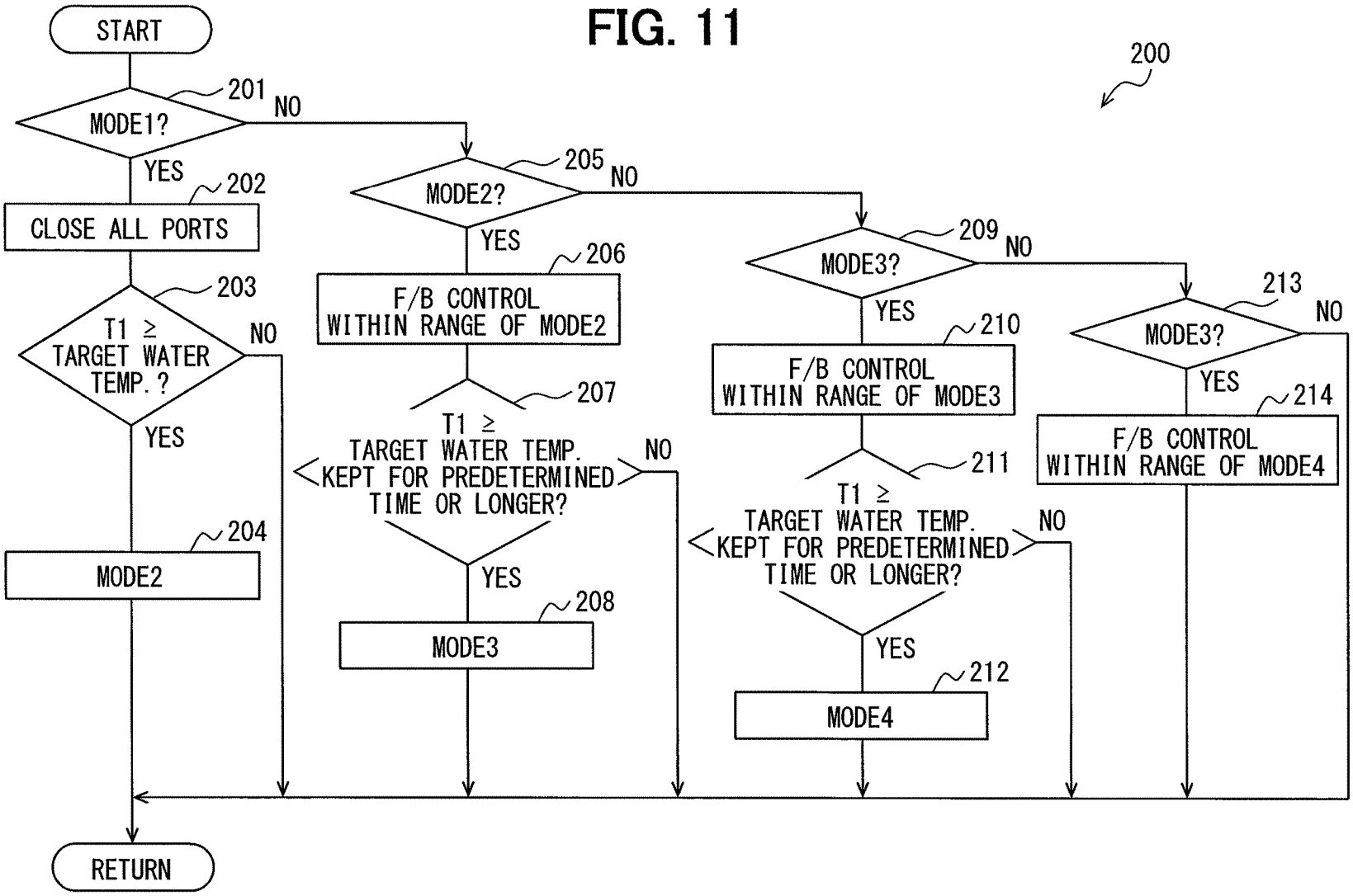
FIG. 11 is a flowchart illustrating a processing flow of a mode switching routine in the second embodiment.

The mode switching routine 200 shown in FIG. 11 is performed repetitively in predetermined cycles while the power supply of the ECU 24 is ON. When the routine 200 is started, whether the control mode is MODE 1 is determined in Step 201 first. The control mode is set to MODE 1 when the engine 11 is started or immediately after the power supply of the ECU 24 is switched ON.

When it is determined in Step 201 that the control mode is MODE 1, advancement is made to Step 202, in which all of the radiator port, the heater core port, and the oil cooler port are closed by controlling a valve rotation angle of the flow rate control valve 15 to be at the fully closed position θ0.

Subsequently, advancement is made to Step 203, in which whether the outlet water temperature T1 detected by an outlet water temperature sensor 22 is higher than or equal to the target water temperature is determined. When it is determined that the outlet water temperature T1 is lower than the target water temperature, the routine 200 is ended while the control mode is set in MODE 1.

Advancement is made to Step 204 subsequently when it is determined in Step 203 that the outlet water temperature T1 is higher than or equal to the target water temperature. In Step 204, the control mode is switched to MODE 2 and the routine 200 is ended. Herein, in a case where learning of the heater-core-flow-path closed position θ1 is not completed, the control mode may be switched to MODE 2 after the learning of the heater-core-flow-path closed position θ1 is completed.

On the other hand, when it is determined in Step 201 that the control mode is not MODE 1, advancement is made to Step 205, in which whether the control mode is MODE 2 is determined. When it is determined in Step 205 that the control mode is MODE 2, advancement is made to Step 206, in which a valve rotation angle of the flow rate control valve 15 is F/B controlled within the available range of MODE 2 (see FIG. 10) on the basis of a deviation between the outlet water temperature T1 detected by the outlet water temperature sensor 22 and the target water temperature. Accordingly, a cooling-water flow rate in the heater core flow path 17 is controlled by controlling an opening degree of the heater core port so as to reduce a deviation between the outlet water temperature T1 and the target water temperature.

Subsequently, advancement is made to Step 207, in which whether the outlet water temperature T1 detected by the outlet water temperature sensor 22 is kept higher than or equal to the target water temperature for a predetermined time or longer is determined. When it is determined that the outlet water temperature T1 is not kept higher than or equal to the target water temperature for the predetermined time or longer, the routine 200 is ended while the control mode is set in MODE 2.

Advancement is made to Step 208 subsequently when it is determined in Step 207 that the outlet water temperature T1 is kept higher than or equal to the target water temperature for the predetermined time or longer. In Step 208, the control mode is switched to MODE 3 and the routine 200 is ended. Herein, in a case where learning of the oil-cooler-flow-path closed position θ2 is not completed, the control mode may be switched to MODE 3 after learning of the oil-cooler-flow-path closed position θ2 is completed.

On the other hand, when it is determined in Step 205 that the control mode is not MODE 2, advancement is made to Step 209, in which whether the control mode is MODE 3 is determined.

When it is determined in Step 209 that the control mode is MODE 3, advancement is made to Step 210, in which a valve rotation angle of the flow rate control valve 15 is FIB controlled within the available range of MODE 3 (see FIG. 10) on the basis of a deviation between the outlet water temperature T1 detected by the outlet water temperature sensor 22 and the target water temperature. Accordingly, a cooling-water flow rate in the oil cooler flow path 18 is controlled by controlling an opening degree of the oil cooler port so as to reduce a deviation between the outlet water temperature T1 and the target water temperature.

Subsequently, advancement is made to Step 211, in which whether the outlet water temperature T1 detected by the outlet water temperature sensor 22 is kept higher than or equal to the target water temperature for a predetermined time or longer is determined. When it is determined that the outlet water temperature T1 is not kept higher than or equal to the target water temperature for the predetermined time or longer, the routine 200 is ended while the control mode is set in MODE 3.

Advancement is made to Step 212 subsequently when it is determined in Step 211 that the outlet water temperature T1 is kept higher than or equal to the target water temperature for the predetermined time or longer. In Step 212, the control mode is switched to MODE 4 and the routine 200 is ended. Herein, in a case where learning of the radiator-flow-path closed position θ3 is not completed, the control mode may be switched to MODE 4 after learning of the radiator-flow-path closed position θ3 is completed.

On the other hand, when it is determined in Step 209 that the control mode is not MODE 3, advancement is made to Step 213, in which whether the control mode is MODE 4 is determined.

When it is determined in Step 213 that the control mode is MODE 4, advancement is made to Step 214, in which a valve rotation angle of the flow rate control valve 15 is F/B controlled within the available range of MODE 4 (see FIG. 10) on the basis of a deviation between the outlet water temperature T1 detected by the outlet water temperature sensor 22 and the target water temperature. Accordingly, a cooling-water flow rate in the radiator flow path 16 is controlled by controlling an opening degree of the radiator port so as to reduce a deviation between the outlet water temperature T1 and the target water temperature.

Figure 12:
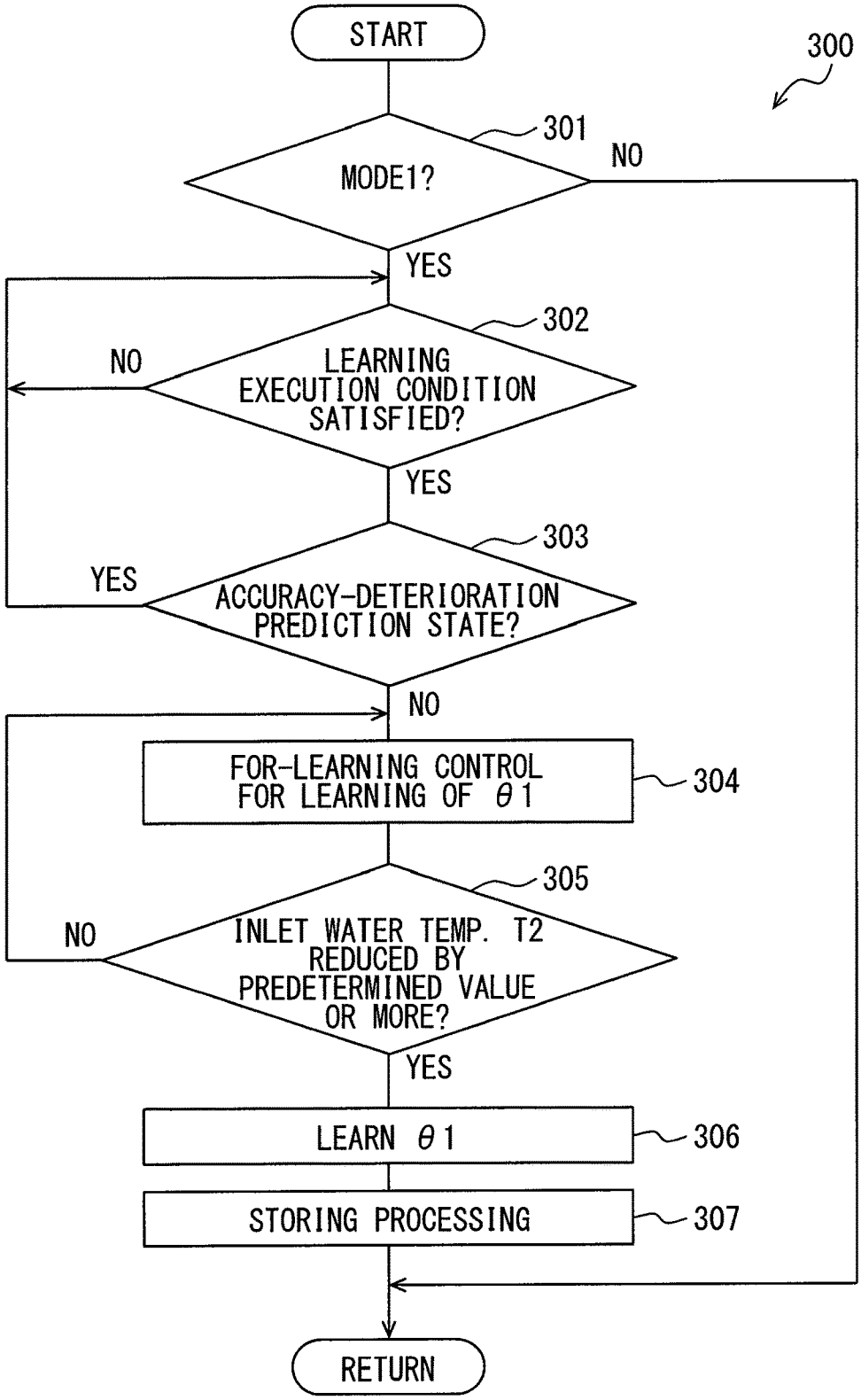
FIG. 12 is a flowchart illustrating a processing flow of a heater-core-flow-path closed position learning routine in the second embodiment.

The learning routine 300 for the heater-core-flow-path closed position, shown in FIG. 12, is performed repetitively in predetermined cycles while the power supply of the ECU 24 is ON. A portion of the ECU 24 performing the learning routine 300 for the heater-core-flow-path closed position may be used as an example of a closed position learning device learning a flow-path closed position. When the routine 300 is started, whether the control mode is MODE 1 is determined in Step 301 first. When it is determined that the control mode is not MODE 1, the routine 300 is ended without performing processing in Step 302 and subsequent steps.

On the other hand, when it is determined in Step 301 that the control mode is MODE 1, advancement is made to Step 302, in which whether a learning execution condition of the heater-core-flow-path closed position θ1 is satisfied is determined depending on, for example, whether the outlet water temperature T1 is higher than or equal to a predetermined value (for example, the target water temperature or a temperature slightly lower than the target water temperature).

Advancement is made to Step 303 when it is determined in Step 302 that the learning execution condition of the heater-core-flow-path closed position θ1 is satisfied. In Step 303, it is determined whether an accuracy-deterioration prediction state exists, that is, whether it is in a state where a learning accuracy of the heater-core-flow-path closed position θ1 is predicted to be deteriorated. For example, the accuracy-deterioration prediction state is determined to exist depending on whether at least one of conditions (1) through (6) as follows is met.

(1) Fuel injection to the engine 11 is stopped.

(2) A cylinder cutoff operation in which combustion of a part of cylinders of the engine 11 is inhibited is performed.

(3) A vehicle is running only on motor power in EV running by stopping an operation of the engine 11 (only in the case of a hybrid vehicle).

(4) A vehicle is stopped.

(5) A vehicle speed is higher than or equal to a predetermined value in a high speed running.

(6) An outside air temperature is lower than or equal to a predetermined value in a low temperature state.

The accuracy-deterioration prediction state can be determined during the fuel supply stop, the cylinder cutoff operation, the EV running, or the vehicle stop, because an amount of heat generation and a flow rate of cooling water of the engine 11 are reduced from normal values and a behavior of the inlet water temperature T2 (determination parameter) upon a valve rotation angle of the flow rate control valve 15 exceeding the flow-path closed position becomes different from a normal behavior. The accuracy-deterioration prediction state can be determined during the high-speed running or the low temperature state in which the outside air is lower than or equal to the predetermined value, because an amount of heat released from cooling water is increased from a normal value and a behavior of the inlet water temperature T2 (determination parameter) upon a valve rotation angle of the flow rate control valve 15 exceeding the flow-path closed position becomes different from a normal behavior.

When at least one of the conditions (1) through (6) is met, the accuracy-deterioration prediction state is determined to exist. When any one of the conditions (1) through (6) is not met, the accuracy-deterioration prediction state is determined not to exist.

When the accuracy-deterioration prediction state is determined to exist in Step 303, the flow returns to Step 302 after learning of the heater-core-flow-path closed position θ1 is inhibited.

Advancement is made to Step 304 subsequently when the accuracy-deterioration prediction state is determined not to exist in Step 303. In Step 304, a for-learning control of the heater-core-flow-path closed position θ1 is performed. As is shown in FIG. 15, in the for-learning control of the heater-core-flow-path closed position θ1, the heater core port is closed, that is, the heater core flow path 17 is closed first by controlling a valve rotation angle of the flow rate control valve 15 to be at a reference position θb1 in the for-learning control of the heater-core-flow-path closed position θ1.

The reference position θb1 in the for-learning control of the heater-core-flow-path closed position θ1 is set to a valve rotation angle that is returned from a last learning value of the heater-core-flow-path closed position θ1 by a predetermined amount in a closing direction of the heater core port. Alternatively, the reference position θb1 may be set to a valve rotation angle that is returned from a temporary learning value (for example, a design center value of the heater-core-flow-path closed position θ1) by a predetermined amount in the closing direction of the heater core port.

Figure 15:
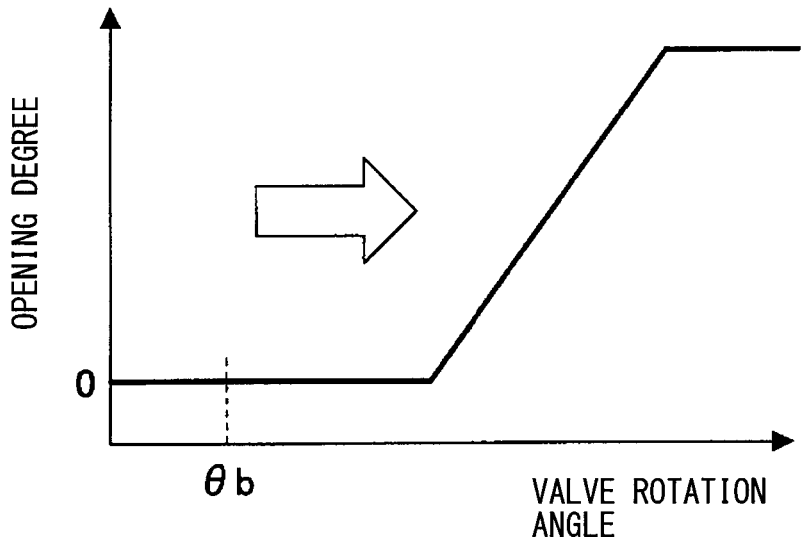
FIG. 15 is a diagram illustrating a for-learning control in the second embodiment.
Figure 16:
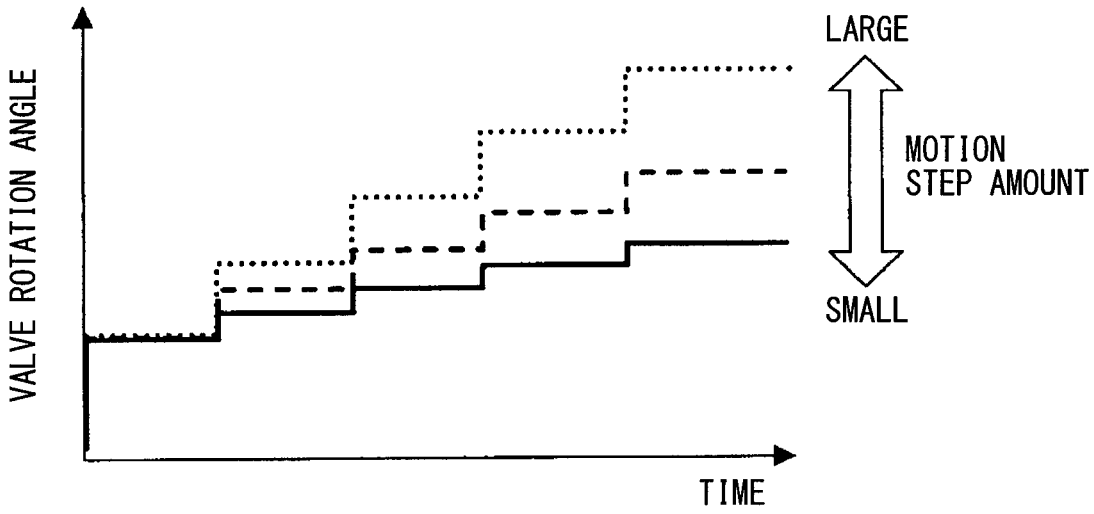
FIG. 16 is a diagram illustrating a setting method of a motion step amount of a flow rate control valve in the second embodiment.
Figure 17:
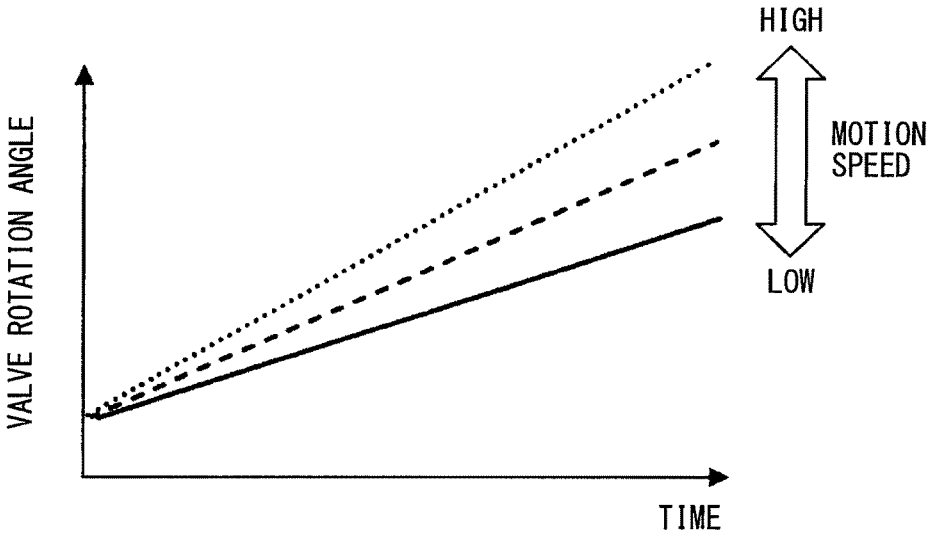
FIG. 17 is a diagram illustrating a setting method of a motion speed of the flow rate control valve in the second embodiment.
Figure 18:
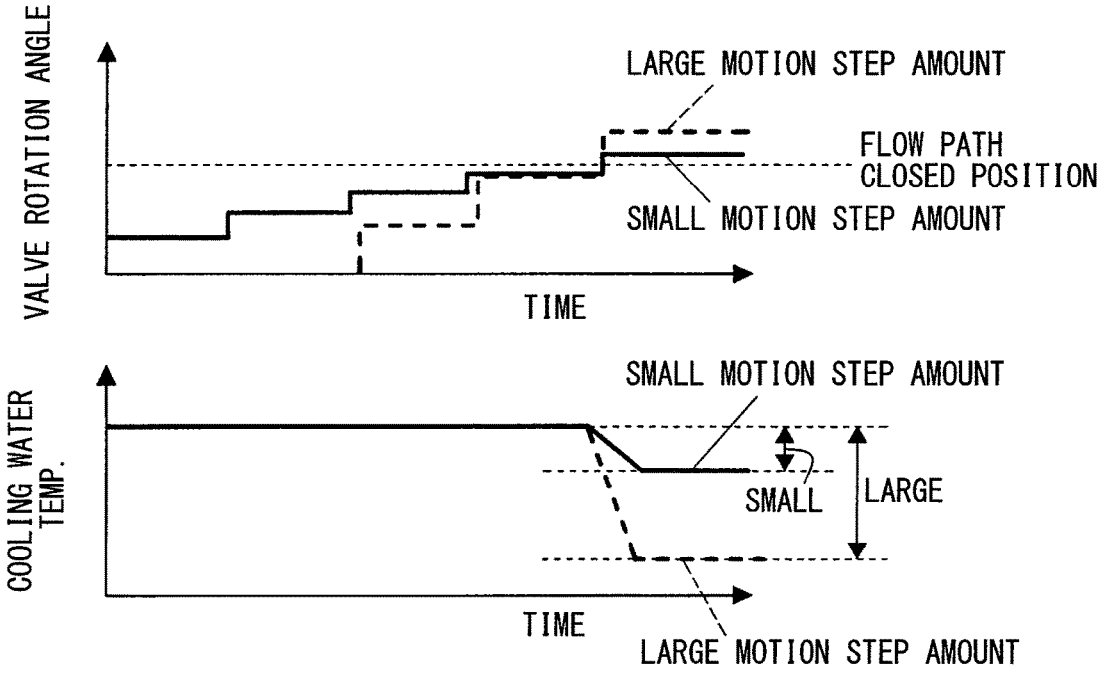
FIG. 18 is a diagram illustrating an effect when the motion step amount of the flow rate control valve is reduced in the second embodiment.

The valve rotation angle of the flow rate control valve 15 is then varied from the reference position θb1 by a predetermined motion step amount at a time or at a predetermined motion speed in an opening direction of the heater core port (a direction indicated by an arrow of FIG. 15). It should be noted that a motion step amount or a motion speed of the flow rate control valve 15 is set according to an outside air temperature, a rotation speed of a water pump 13, and the number of open flow paths. The phrase, "the number of open flow paths", means the number of flow paths among the radiator flow path 16, the heater core flow path 17, and the oil cooler flow path 18, which is open.

More specifically, a motion step amount (see FIG. 16) or a motion speed (see FIG. 17) of the flow rate control valve 15 is reduced as an outside air temperature becomes lower. Also, a motion step amount (see FIG. 16) or a motion speed (see FIG. 17) of the flow rate control valve 15 is reduced as a rotation speed of the water pump 13 (engine rotation speed) becomes higher. Further, a motion step amount (see FIG. 16) or a motion speed (see FIG. 17) of the flow rate control valve 15 is reduced as the number of open flow paths becomes smaller. Herein, the number of open flow paths is "0" when the heater-core-flow-path closed position θ1 is learned, "1" when the oil-cooler-flow-path closed position θ2 is learned, and "2" when the radiator-flow-path closed position θ3 is learned.

For example, a map of a motion step amount or a motion speed using an outside air temperature, a rotation speed of the water pump 13, and the number of open flow paths as parameters may be prepared and a motion step amount or a motion speed corresponding to an outside air temperature, a rotation speed of the water pump 13, and the number of open flow paths may be calculated using the map. Alternatively, a motion step amount or a motion speed corresponding to an outside air temperature, a rotation speed of the water pump 13, and the number of open flow paths may be found by correcting a base value of a motion step amount or a base value of a motion speed using a correction value corresponding to an outside air temperature, a correction value corresponding to a rotation speed of the water pump 13, and a correction value corresponding to the number of open flow paths.

Subsequently, advancement is made to Step 305, in which whether the inlet water temperature T2 detected by an inlet water temperature sensor 23 has dropped by a predetermined value or more is determined. When it is determined in Step 305 that the inlet water temperature T2 has not dropped by the predetermined value or more, the flow returns to Step 304 to continue the for-learning control.

Subsequently, advancement is made to Step 306 on the grounds that the inlet water temperature T2 started to drop when it is determined in Step 305 that the inlet water temperature T2 has dropped by the predetermined value or more. In Step 306, the heater-core-flow-path closed position θ1 is learned as a valve rotation angle of the flow rate control valve 15 immediately before the inlet water temperature T2 starts to drop (that is, a last valve rotation angle of the flow rate control valve 15).

Subsequently, advancement is made to Step 307, in which storing processing to update a learning value (stored value) of the heater-core-flow-path closed position θ1 is performed by storing a latest learning value of the heater-core-flow-path closed position θ1 into a rewritable non-volatile memory, such as a backup RAM of the ECU 24.

Figure 13:
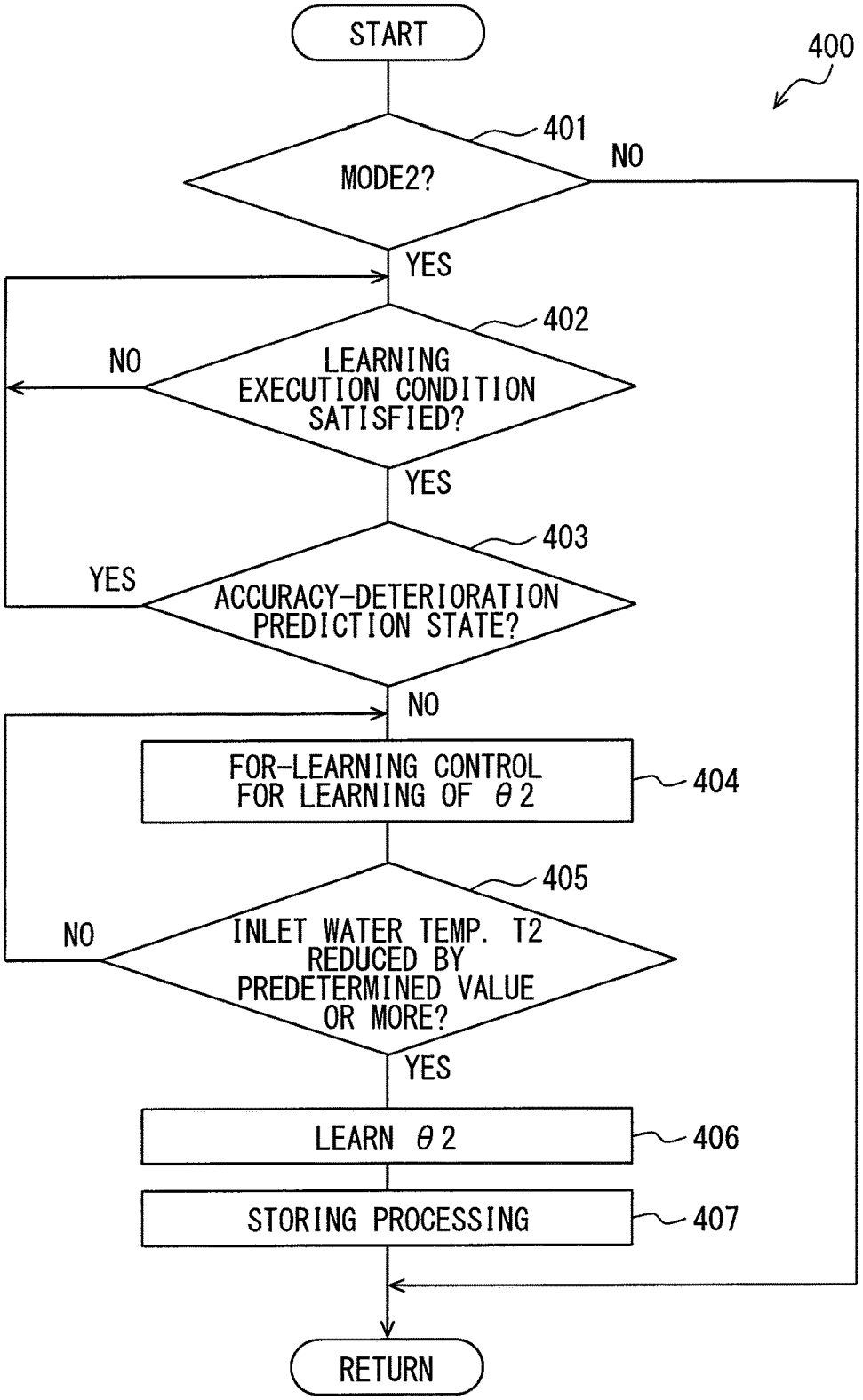
FIG. 13 is a flowchart illustrating a processing flow of an oil-cooler-flow-path closed position learning routine in the second embodiment.

The learning routine 400 for the oil-cooler-flow-path closed position, shown in FIG. 13, is performed repetitively in predetermined cycles while the power supply of the ECU 24 is ON. A portion of the ECU 24 performing the learning routine 400 for the oil-cooler-flow-path closed position may be used as an example of a closed position learning device learning a flow-path closed position. When the routine 400 is started, whether the control mode is MODE 2 is determined in Step 401 first. When it is determined that the control mode is not MODE 2, the routine 400 is ended without performing processing in Step 402 and subsequent steps.

On the other hand, when it is determined in Step 401 that the control mode is MODE 2, advancement is made to Step 402, in which whether a learning execution condition of the oil-cooler-flow-path closed position θ2 is satisfied is determined depending on, for example, whether the variation in the outlet water temperature T1 per predetermined time, ΔT1, is smaller than or equal to a predetermined value (whether the outlet water temperature T1 is stable).

Advancement is made to Step 403 when it is determined in Step 402 that the learning execution condition of the oil-cooler-flow-path closed position θ2 is satisfied. In Step 403, it is determined, in the same manner as in Step 303 of FIG. 12 described above, whether the accuracy-deterioration prediction state exists, that is, whether it is in a state where a learning accuracy of the oil-cooler-flow-path closed position θ2 is predicted to be deteriorated. When the accuracy-deterioration prediction state is determined to exist in Step 403, the flow returns to Step 402 after learning of the oil-cooler-flow-path closed position θ2 is inhibited.

Advancement is made to Step 404 subsequently when the accuracy-deterioration prediction state is determined not to exist in Step 403. In Step 404, a for-learning control of the oil-cooler-flow-path closed position θ2 is performed. In the for-learning control of the oil-cooler-flow-path closed position θ2, the oil cooler port is closed (the oil cooler flow path 18 is closed) first by controlling a valve rotation angle of the flow rate control valve 15 to be at a reference position θb2 in the for-learning control of the oil-cooler-flow-path closed position θ2.

The reference position θb2 in the for-learning control of the oil-cooler-flow-path closed position θ2 is set to a valve rotation angle returned from a last learning value of the oil-cooler-flow-path closed position θ2 by a predetermined amount in a closing direction of the oil cooler port. Alternatively, the reference position θb2 may be set to a valve rotation angle returned from a temporary learning value (for example, a design center value of the oil-cooler-flow-path closed position θ2) by a predetermined amount in the closing direction of the oil cooler port.

The valve rotation angle of the flow rate control valve 15 is then varied from the reference position θb2 by a predetermined motion step amount at a time or at predetermined motion speed in an opening direction of the oil cooler port. It should be noted that a motion step amount or a motion speed of the flow rate control valve 15 is set according to an outside air temperature, a rotation speed of the water pump 13, and the number of open flow paths in the same manner as in Step 304 of FIG. 12 described above. That is to say, a motion step amount or a motion speed of the flow rate control valve 15 is reduced as an outside air temperature becomes lower. Also, a motion step amount or a motion speed of the flow rate control valve 15 is reduced as a rotation speed of the water pump 13 (engine rotation speed) becomes higher. Further, a motion step amount or a motion speed of the flow rate control valve 15 is reduced as the number of open flow paths becomes smaller.

Subsequently, advancement is made to Step 405, in which whether the inlet water temperature T2 detected by the inlet water temperature sensor 23 has dropped by a predetermined value or more is determined. When it is determined in Step 405 that the inlet water temperature T2 has not dropped by the predetermined value or more, the flow returns to Step 404 to continue the for-learning control.

Subsequently, advancement is made to Step 406 on the grounds that the inlet water temperature T2 started to drop when it is determined in Step 405 that the inlet water temperature T2 has dropped by the predetermined value or more. In Step 406, the oil-cooler-flow-path closed position θ2 is learned as a valve rotation angle of the flow rate control valve 15 immediately before the inlet water temperature T2 starts to drop (a last valve rotation angle of the flow rate control valve 15).

Subsequently, advancement is made to Step 407, in which storing processing to update a learning value (stored value) of the oil-cooler-flow-path closed position θ2 is performed by storing a latest learning value of the oil-cooler-flow-path closed position θ2 into a rewritable non-volatile memory, such as a backup RAM of the ECU 24.

Figure 14:
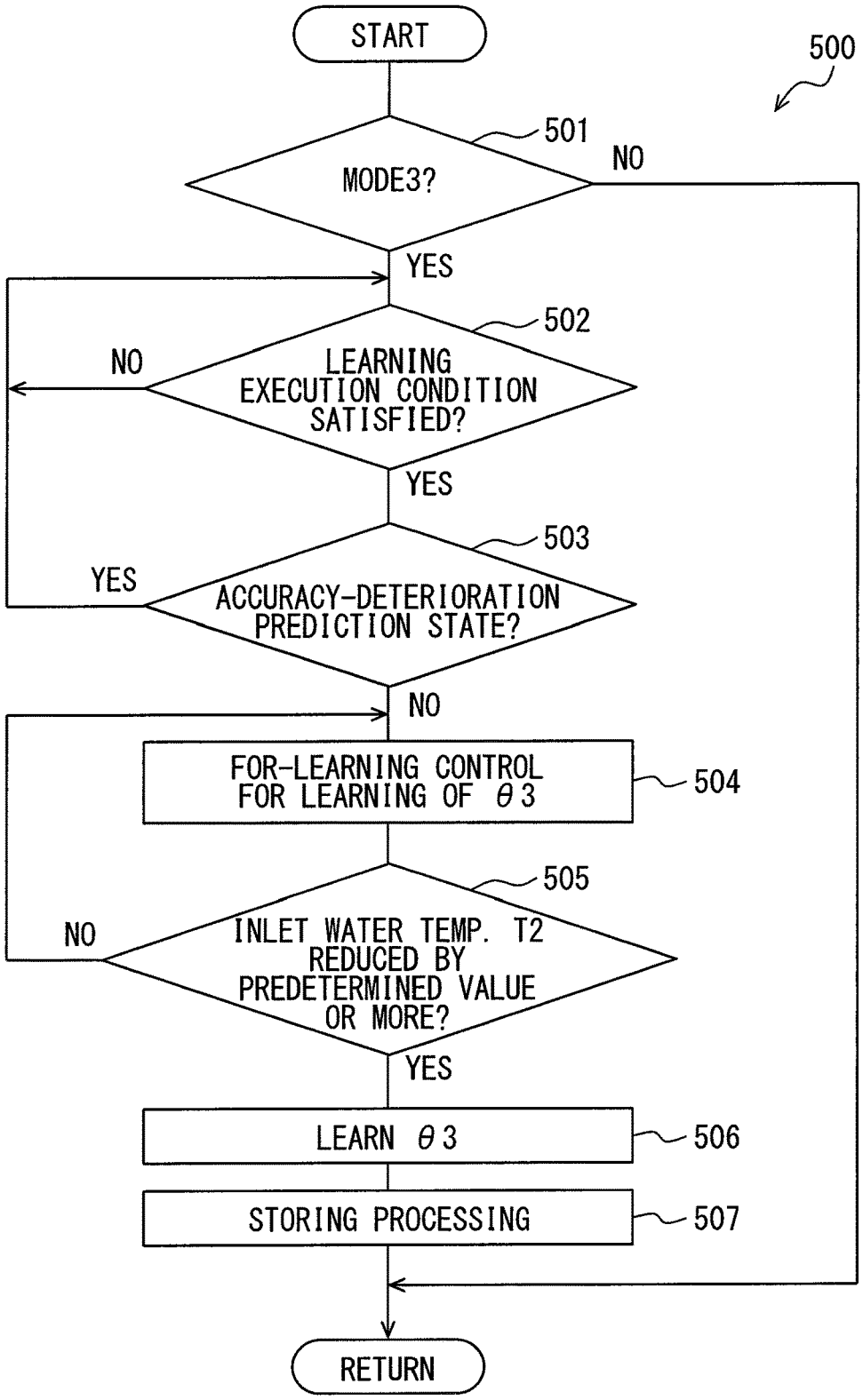
FIG. 14 is a flowchart illustrating a processing flow of a radiator-flow-path closed position learning routine in the second embodiment.

The learning routine 500 for the radiator-flow-path closed position, shown in FIG. 14, is performed repetitively in predetermined cycles while the power supply of the ECU 24 is ON. A portion of the ECU 24 performing the learning routine 500 for the radiator-flow-path closed position may be used as an example of a closed position learning device learning a flow-path closed position. When the routine 500 is started, whether the control mode is MODE 3 is determined in Step 501 first. When it is determined that the control mode is not MODE 3, the routine 500 is ended without performing processing in Step 502 and subsequent steps.

On the other hand, when it is determined in Step 501 that the control mode is MODE 3, advancement is made Step 502, in which whether a learning execution condition of the radiator-flow-path closed position θ3 is satisfied is determined depending on, for example, whether the variation in the outlet water temperature T1 per predetermined time, ΔT1, is smaller than or equal to a predetermined value (whether the outlet water temperature T1 is stable).

Advancement is made to Step 503 when it is determined in Step 502 that the learning execution condition of the radiator-flow-path closed position θ3 is satisfied. In Step 503, it is determined, in the same manner as in Step 303 of FIG. 12 described above, whether the accuracy-deterioration prediction state exists, that is, whether it is in a state where a learning accuracy of the radiator-flow-path closed position θ3 is predicted to be deteriorated. When the accuracy-deterioration prediction state is determined to exist in Step 503, the flow returns to Step 502 after learning of the radiator-flow-path closed position θ3 is inhibited.

Advancement is made to Step 504 subsequently when the accuracy-deterioration prediction state is determined not to exist in Step 503. In Step 504, a for-learning control of the radiator-flow-path closed position θ3 is performed. In the for-learning control of the radiator-flow-path closed position θ3, the radiator port is closed, that is, the radiator flow path 16 is closed first by controlling a valve rotation angle of the flow rate control valve 15 to be at a reference position θb3 in the for-learning control of the radiator-flow-path closed position θ3.

The reference position θb3 in the for-learning control of the radiator-flow-path closed position θ3 is set to a valve rotation angle returned from a last learning value of the radiator-flow-path closed position θ3 by a predetermined amount in a closing direction of the radiator port. Alternatively, the reference position θb3 may be set to a valve rotation angle returned from a temporary learning value (for example, a design center value of the radiator-flow-path closed position θ3) by a predetermined amount in the closing direction of the radiator port.

The valve rotation angle of the flow rate control valve 15 is then varied from the reference position θb3 by a predetermined motion step amount at a time or at a predetermined motion speed in an opening direction of the radiator port. It should be noted that a motion step amount or a motion speed of the flow rate control valve 15 is set according to an outside air temperature, a rotation speed of the water pump 13, and the number of open flow paths in the same manner as in Step 304 of FIG. 12 described above. That is to say, a motion step amount or a motion speed of the flow rate control valve 15 is reduced as an outside air temperature becomes lower. Also, a motion step amount or a motion speed of the flow rate control valve 15 is reduced as a rotation speed of the water pump 13 (engine rotation speed) becomes higher. Further, a motion step amount or a motion speed of the flow rate control valve 15 is reduced as the number of open flow paths becomes smaller.

Subsequently, advancement is made to Step 505, in which whether the inlet water temperature T2 detected by the inlet water temperature sensor 23 has dropped by a predetermined value or more is determined. When it is determined in Step 505 that the inlet water temperature T2 has not dropped by the predetermined value or more, the flow returns to Step 504 to continue the for-learning control.

Subsequently, advancement is made to Step 506 on the grounds that the inlet water temperature T2 started to drop when it is determined in Step 505 that the inlet water temperature T2 has dropped by the predetermined value or more. In Step 506, the radiator-flow-path closed position θ3 is learned as a valve rotation angle of the flow rate control valve 15 immediately before the inlet water temperature T2 starts to drop (that is, a last valve rotation angle of the flow rate control valve 15).

Subsequently, advancement is made to Step 507, in which storing processing to update a learning value (stored value) of the radiator-flow-path closed position θ3 is performed by storing a latest learning value of the radiator-flow-path closed position θ3 into a rewritable non-volatile memory, such as a backup RAM of the ECU 24.

In the second embodiment described above, the heater-core-flow-path closed position θ1, the oil-cooler-flow-path closed position θ2, and the radiator-flow-path closed position θ3 of the flow rate control valve 15 are learned. Owing to the configuration as above, even when the heater-core-flow-path closed position θ1, the oil-cooler-flow-path closed position θ2, and the radiator-flow-path closed position θ3 of the flow rate control valve 15 have varied due to an individual difference (for example, production tolerance) or deterioration with time of the flow rate control valve 15, corresponding correct flow-path closed positions can be found by learning the varied flow-path closed positions. Consequently, control performance on a cooling water temperature in the respective control modes (MODE 2 through MODE 4) can be enhanced.

In the second embodiment, it is determined whether the accuracy-deterioration prediction state exists, that is, whether it is in a state where a learning accuracy of the flow-path closed position is predicted to be deteriorated. When the accuracy-deterioration prediction state is determined to exist, learning of the flow-path closed position is inhibited. When configured as above, deterioration in learning accuracy of the flow-path closed position can be forestalled and hence incorrect learning of the flow-path closed position can be avoided.

In the second embodiment, the accuracy-deterioration prediction state is determined to exist when at least one of conditions is met, the conditions including the fuel supply being stopped, the cylinder cutoff operation being performed, the EV running, the vehicle being stopped, the high-speed running, and the low temperature state in which an outside air temperature is lower than or equal to a predetermined value. The accuracy-deterioration prediction state can be determined to exist during the fuel supply stop, the cylinder cutoff operation, the EV running, or the vehicle stop, because an amount of heat generation and a flow rate of cooling water of the engine 11 are reduced from normal values and a behavior of the inlet water temperature T2 (determination parameter) upon a valve rotation angle of the flow rate control valve 15 exceeding the flow-path closed position becomes different from a normal behavior. The accuracy-deterioration prediction state can be also determined to exist during the high-speed running or the low temperature state in which an outside air is lower than or equal to the predetermined value, because an amount of heat released from cooling water increases from a normal value and a behavior of the inlet water temperature T2 (determination parameter) upon a valve rotation angle of the flow rate control valve 15 exceeding the flow-path closed position becomes different from a normal behavior.

In order to perform the for-learning control by which the flow rate control valve 15 is operated to learn the flow-path closed position, a valve rotation angle of the flow rate control valve 15 has to be varied until the valve rotation angle of the flow rate control valve 15 exceeds the flow-path closed position and a cooling water temperature (inlet water temperature T2) varies. A cooling water leakage amount from an engine side to a flow path side increases comparably to an excess amount in the valve rotation angle of the flow rate control valve 15 over the flow-path closed position. Hence, the cooling water temperature may become lower as an outside air temperature becomes lower and warm-up of the engine 11 may possibly be delayed.

In the second embodiment, a motion step amount or a motion speed of the flow rate control valve 15 is more reduced the lower outside air temperature is during the for-learning control. When configured as above, an excess amount in a valve rotation angle of the flow rate control valve 15 over the flow-path closed position can be lessened by reducing the motion step amount or the motion speed of the flow rate control valve 15 more as an outside air temperature becomes lower. Accordingly, a cooling water leakage amount can be reduced. Consequently, even when an outside air temperature is low, a delay of warm-up can be restricted by reducing a drop in the cooling water temperature caused by the for-learning control (see FIG. 18). Moreover, a learning error of the flow-path closed position (that is, a difference between a learning value of the flow-path closed position and a correct flow-path closed position) can be lessened by reducing the motion step amount or the motion speed of the flow rate control valve 15. Hence, learning accuracy can be enhanced.

A flow rate of cooling water tends to vary in response to a variance of an opening degree of the flow rate control valve 15 more significantly as a rotation speed of the water pump 13 becomes higher. Hence, even when a valve rotation angle of the flow rate control valve 15 exceeds the flow-path closed position to the same extent, a cooling water leakage amount from the engine side to the flow path side increases as a rotation speed of the water pump 13 becomes higher.

In the second embodiment, a motion step amount or a motion speed of the flow rate control valve 15 is more reduced the higher rotation speed of the water pump 13 (engine rotation speed) is during the for-learning control. When configured as above, an excess amount in a valve rotation angle of the flow rate control valve 15 over the flow-path closed position can be lessened by reducing a motion step amount or a motion speed of the flow rate control valve 15 correspondingly to a flow rate of cooling water which varies in response to a variance of an opening degree of the flow rate control valve 15 more significantly as a rotation speed of the water pump 13 becomes higher. Hence, an increase of a cooling water leakage amount can be restricted. Consequently, even when a rotation speed of the water pump 13 is high, a delay of warm-up can be restricted by reducing a drop in the cooling water temperature caused by the for-learning control (see FIG. 18). Moreover, a learning error of the flow-path closed position can be lessened by reducing the motion step amount or the motion speed of the flow rate control valve 15. Hence, learning accuracy can be enhanced.

Also, a flow rate of cooling water tends to vary in response to a variance of an opening degree of the flow rate control valve 15 more significantly as the number of open flow paths (the number of open paths among the cooling water flow paths 16 through 18) becomes smaller. Hence, even when a valve rotation angle of the flow rate control valve 15 exceeds the flow rate closed position to the same extent, a cooling water leakage amount from the engine side to the flow path side increases as the number of open flow paths becomes smaller.

In the second embodiment, a motion step amount or a motion speed of the flow rate control valve 15 is more reduced the smaller number of open flow paths is during the for-learning control. When configured as above, an excess amount in a valve rotation angle of the flow rate control valve 15 over the flow-path closed position can be lessened by reducing a motion step amount or a motion speed of the flow rate control valve 15 correspondingly to a flow rate of cooling water which varies in response to a variance of an opening degree of the flow rate control valve 15 more significantly as the number of open flow paths becomes smaller. Hence, an increase of a cooling water leakage amount can be restricted. Consequently, even when the number of open flow paths is small, a delay of warm-up can be restricted by reducing a drop in the cooling water temperature caused by the for-learning control (see FIG. 18). Moreover, a learning error of the flow-path closed position can be lessened by reducing the motion step amount or the motion speed of the flow rate control valve 15. Hence, learning accuracy can be enhanced.

In the second embodiment above, a motion step amount or a motion speed of the flow rate control valve 15 is set according to an outside air temperature, a rotation speed of the water pump 13, and the number of open flow paths during the for-learning control. The present disclosure, however, is not limited to the configuration as above, and a motion step amount or a motion speed of the flow rate control valve 15 may be set according to one or two of an outside air temperature, a rotation speed of the water pump 13, and the number of open flow paths.

In the second embodiment, the flow-path closed position is learned on the basis of the inlet water temperature. However, the present disclosure is not limited to the configuration as above. For example, the flow-path closed position may be learned on the basis of the outlet water temperature or the flow-path closed position may be learned on the basis of both of the inlet water temperature and the outlet water temperature.

In each of the first and second embodiments above, the learning value (stored value) of the flow-path closed position is updated each time the flow-path closed position is learned. However, the present disclosure is not limited to the configuration as above. For example, because the flow-path closed position is thought to vary with a fully closed position or a fully opened position of the flow rate control valve 15, the learning value of the flow-path closed position may be updated when at least one of or both of the fully closed position and the fully opened position vary by a predetermined value or more.

In each of the first and second embodiment above, the flow-path closed position is learned on the basis of a cooling water temperature (outlet water temperature or inlet water temperature) detected by the water temperature sensor. However, the present disclosure is not limited to the configuration as above. For example, the flow-path closed position may be learned on the basis of a pressure of cooling water detected by a pressure sensor, a flow rate of cooling water detected by a flow rate sensor, or a rotation speed of the water pump 13. A pressure of cooling water, a flow rate of cooling water, a rotation speed of the water pump 13 vary when a valve rotation angle of the flow rate control valve 15 exceeds the flow-path closed position. Hence, the flow-path closed position can be learned by monitoring a pressure of cooling water, a flow rate of cooling water, and a rotation speed of the water pump 13.

In each of the first and second embodiments above, the present disclosure is applied to a system in which flow paths are opened in the following order: the heater core flow path→the oil cooler flow path→the radiator flow path (the heater core port→the oil cooler port→the radiator port) as a valve rotation angle of the flow rate control valve increases. However, an application of the present disclosure is not limited to the system configured as above. For example, the present disclosure may be applied to a system in which flow paths are opened in another order as follows: the oil cooler flow path→the heater core flow path→the radiator flow path (the oil cooler port→the heater core port→the radiator port) or a system in which flow paths are opened in any other order as a valve rotation angle of the flow rate control valve increases.

In each of the first and second embodiments above, the present disclosure is applied to a system in which flow rates in the respective cooling-water flow paths (the heater core flow path, the oil cooler flow path, and the radiator flow path) are regulated by a single flow rate control valve. However, an application of the present disclosure is not limited to the system configured as above, and the present disclosure may be applied to a system in which flow rates in the respective cooling-water flow paths are regulated by multiple (two or more) flow rate control valves.

Further, the present disclosure may be applied to a system provided with cooling-water flow paths other than the flow paths described above (for example, an oil cooler flow path provided with an oil cooler for transmission oil, an EGR cooler flow path provided with an EGR cooler, a cooling-water flow path to cool a supercharger, or a cooling-water flow path to cool a throttle valve) to learn flow-path closed positions of the other cooling-water flow paths.

In each of the first and second embodiments above, the engine cooling system is provided with a mechanical water pump driven by engine power. However, the present disclosure is not limited to the configuration as above and the engine cooling system may be provided with an electric water pump driven by a motor.

The configuration of the engine cooling system (for example, a connection method of the respective cooling-water flow paths, locations and the number of flow rate control valves, locations and the number of the water temperature sensors) may be changed as needed or modified in various manners within the scope of the present disclosure.

The invention claimed is:

1. A cooling device for an internal combustion engine, comprising:

a cooling-water flow path through which a cooling water of the internal combustion engine flows;

a flow rate control valve regulating flow rate of the cooling water in the cooling-water flow path; and a closed position learning device learning a flow-path closed position which is an operated position of the flow rate control valve when closing the cooling-water flow path; wherein:

the closed position learning device uses, as a determination parameter, at least one of a temperature of the cooling water, a pressure of the cooling water, a flow rate of the cooling water, and a rotation speed of a water pump circulating the cooling water;

the closed position learning device learns the flow-path closed position on a basis of the determination parameter; and the closed position learning device learns, as the flow-path closed position, an operated position of the flow rate control valve immediately before the determination parameter starts to vary during changing of the operated position of the flow rate control valve in an opening direction of the cooling-water flow path from a state where the cooling-water flow path is closed.

2. The cooling device for an internal combustion engine, according to claim 1 wherein: the cooling-water flow path includes at least one of a radiator flow path in which the cooling water circulates through a radiator, a heater core flow path in which the cooling water circulates through a heater core, and an oil cooler flow path in which the cooling water circulates through an oil cooler; and the closed position learning device learns, as the flow-path closed position, at least one of an operated position of the flow rate control valve when closing the radiator flow path, an operated position of the flow rate control valve when closing the heater core flow path, and an operated position of the flow rate control valve when closing the oil cooler flow path.

3. The cooling device for an internal combustion engine, according to claim 1, further comprising at least one of an outlet water temperature sensor detecting an outlet water temperature as a temperature of the cooling water on a cooling water outlet side of the internal combustion engine, and an inlet water temperature sensor detecting an inlet water temperature as a temperature of the cooling water on a cooling water inlet side of the internal combustion engine, wherein the closed position learning device uses at least one of the outlet water temperature and the inlet water temperature as the determination parameter.

4. The cooling device for an internal combustion engine, according to claim 1, further comprising a controller configured to control the operated position of the flow rate control valve based on the flow-path closed position learned by the closed position learning device.

5. A cooling device for an internal combustion engine, comprising:

a cooling-water flow path through which a cooling water of the internal combustion engine flows;

a flow rate control valve regulating a flow rate of the cooling water in the cooling-water flow path; and a closed position learning device learning a flow-path closed position which is an operated position of flow rate control valve when closing the cooling-water flow path;

wherein the closed position learning device determines whether an accuracy-deterioration prediction state exists, the state being when a learning accuracy of the flow-path closed position is predicted to be deteriorated, and the closed position learning device inhibits learning of the flow-path closed position when the accuracy-deterioration prediction state exists.

6. The cooling device for an internal combustion engine, according to claim 5, wherein the closed position learning device determines that the accuracy-deterioration prediction state exists, when at least one of a plurality of conditions is met, the plurality of conditions includes a fuel supply to the internal combustion engine being stopped, the internal combustion engine being in a cylinder cutoff operation, a vehicle running only on motor power in EV running by stopping an operation of the internal combustion engine), the vehicle being stopped, a vehicle speed being higher than or equal to a predetermined value in high speed running, and an outside air temperature being lower than or equal to a predetermined value in a low temperature state.

7. A cooling device for an internal combustion engine, comprising:

a cooling-water flow path through which a cooling water of the internal combustion engine flows;

a flow rate control valve regulating a flow rate of the cooling water in the cooling-water flow path; and a closed position learning device learning a flow-path closed position which is an operated position of the flow rate control valve when closing the cooling-water flow path;

wherein the closed position learning device reduces a motion step amount or a motion speed of the flow rate control valve with decrease in an outside air temperature when the closed position learning device executes a for-learning control to operate the flow rate control valve for learning the flow-path closed position.

8. A cooling device for an internal combustion engine, comprising:

a cooling-water flow path through which a cooling water of the internal combustion engine flows;

a flow rate control valve regulating a flow rate of the cooling water in the cooling-water flow path; and a closed position learning device learning a flow-path closed position which is an operated position of the flow rate control valve when closing the cooling-water flow path;

wherein: the closed position learning device reduces a motion step amount or a motion speed of the flow rate control valve with increase in a rotation speed of the water pump circulating the cooling water when the closed position learning device executes a for-learning control to operate the flow rate control valve for learning the flow-path closed position.

9. A cooling device for an internal combustion engine, comprising:

a cooling-water flow path through which a cooling water of the internal combustion engine flows;

a flow rate control valve regulating flow rate of the cooling water in the cooling-water flow path; and a closed position learning device learning flow-path closed position which is an operated position of the flow rate control valve when closing the cooling-water flow path;

wherein: the closed position learning device reduces a motion step amount or a motion speed of the flow rate control valve with decrease in the number of flow paths of the cooling-water flow path which are open, when the closed position learning device executes a for-learning control to operate the flow rate control valve learning the flow-path closed position.

* * * * *